United States Patent [19]

Bellino et al.

[11] 3,982,622

[45] Sept. 28, 1976

[54] ACTUATOR MECHANISMS FOR WIRE MATRIX PRINTERS

[75] Inventors: Joseph A. Bellino, Arlington Heights; David G. Geis, Chicago; Ingard B. Hodne, Northbrook; Arthur F. Lindberg, Chicago, all of Ill.

[73] Assignee: Teletype Corporation, Skokie, Ill.

[22] Filed: Oct. 4, 1974

[21] Appl. No.: 512,264

[52] U.S. Cl. ..... 197/1 R; 101/93.34; 335/276

[51] Int. Cl.[2] ..... B41J 3/04

[58] Field of Search ..... 197/1 R; 101/93.15, 101/93.16, 93.29, 93.33, 93.34, 93.48, 109, 93.04–93.05, 93.28, 93.32, 93.42; 335/270, 274, 276

[56] References Cited

UNITED STATES PATENTS

| | | | |
|---|---|---|---|
| 3,172,352 | 3/1965 | Helms | 101/93.34 |
| 3,217,640 | 11/1965 | Bradshaw | 197/1 R |
| 3,279,362 | 10/1966 | Helms | 101/93.33 |
| 3,285,166 | 11/1966 | Helms et al. | 101/93.34 |
| 3,386,378 | 6/1968 | Bradbury et al. | 197/1 R X |
| 3,460,469 | 8/1969 | Brown et al. | 101/93.34 |
| 3,672,482 | 6/1972 | Brumbaugh et al. | 197/1 R |
| 3,828,908 | 8/1974 | Schneider | 197/1 R |
| 3,842,734 | 10/1974 | Gomi | 101/93.34 |

*Primary Examiner*—Ralph T. Rader
*Attorney, Agent, or Firm*—J. L. Landis

[57] ABSTRACT

A wire matrix printer includes a print head having one or more banks of a plurality of generally horizontal, vertically spaced print wires arranged parallel to each other for linear reciprocation toward and away from a recording surface by associated actuators. The print wires in each bank are of progressively varying length so that the wire associated with the actuator furthest from the recording surface is the longest and each adjacent wire is a predetermined amount shorter than the preceding wire. Outer or actuator ends of the wires define a vertically spaced and stepped array. The actuators in each bank are also in an array vertically spaced and stepped and are respectively coupled to the outer print wire ends by armatures. The inner or printing ends of the wires define a vertically spaced, nearly planar array near the recording surface, and a spaced, planar array at such surface. If there is more than one bank of print wires, the banks are angularly spaced from a line extending perpendicularly from the recording surface, and the inner ends of the wires in each bank are alternately interleaved near the recording surface.

The actuators in each bank include the armatures, as well as torsion springs, a pair of pole pieces, a permanent magnet and an electrical coil. The armatures are mounted to the pole pieces by both the torsion member and the magnetic attraction of the permanent magnet for generally horizontal, pivoting movement. The pole pieces are magnetized by the permanent magnet to normally attract and hold each armature adjacent thereto against the action of its associated torsion spring thereby storing potential energy therein. The flux of the permanent magnet is selectively counteracted, or neutralized or cancelled for a selected armature by energization of its associated coil to rotate the armature on and about one of its pole pieces for impacting the inner end of the print wire coupled thereto against the recording surface due to conversion of the potential energy stored in the torsion spring to kinetic energy of the armature.

Further details relate to the positioning and geometry of the print wires, the armatures, the pole pieces, the permanent magnets, and the coils in certain environments, such as in print heads of a wire matrix printers.

41 Claims, 15 Drawing Figures

FIG. 4
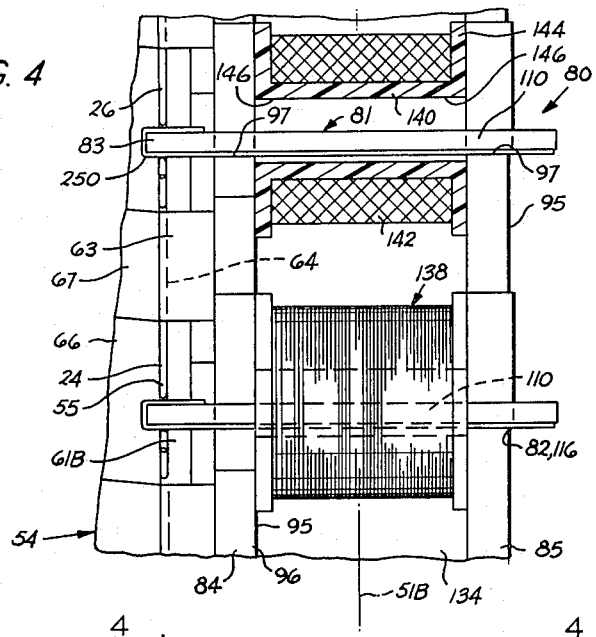
FIG. 5
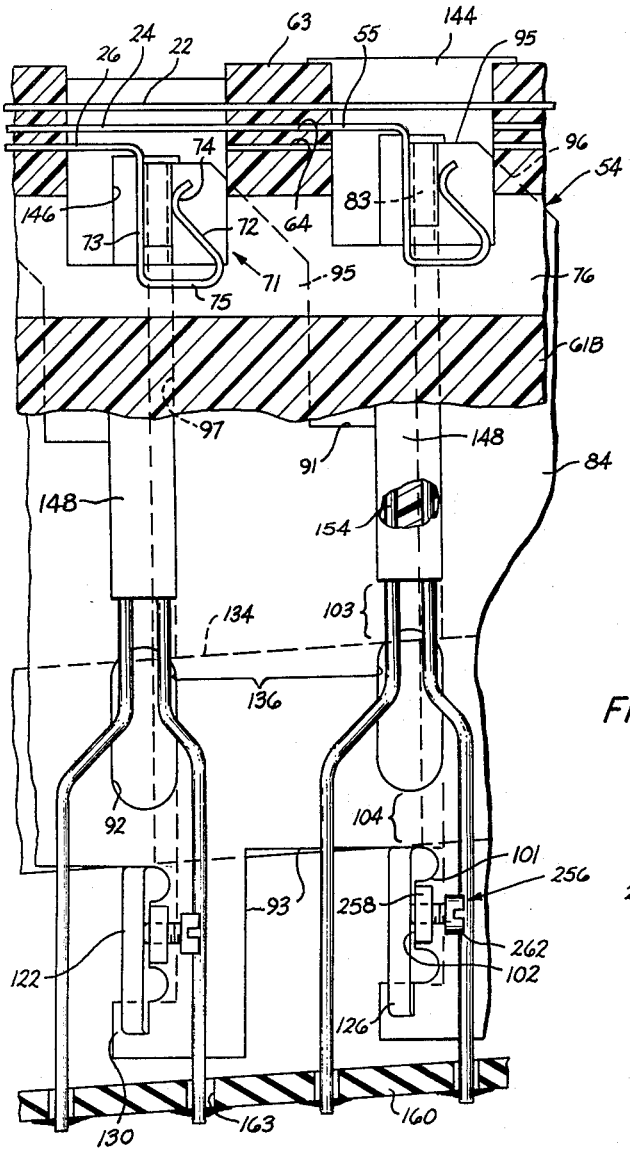
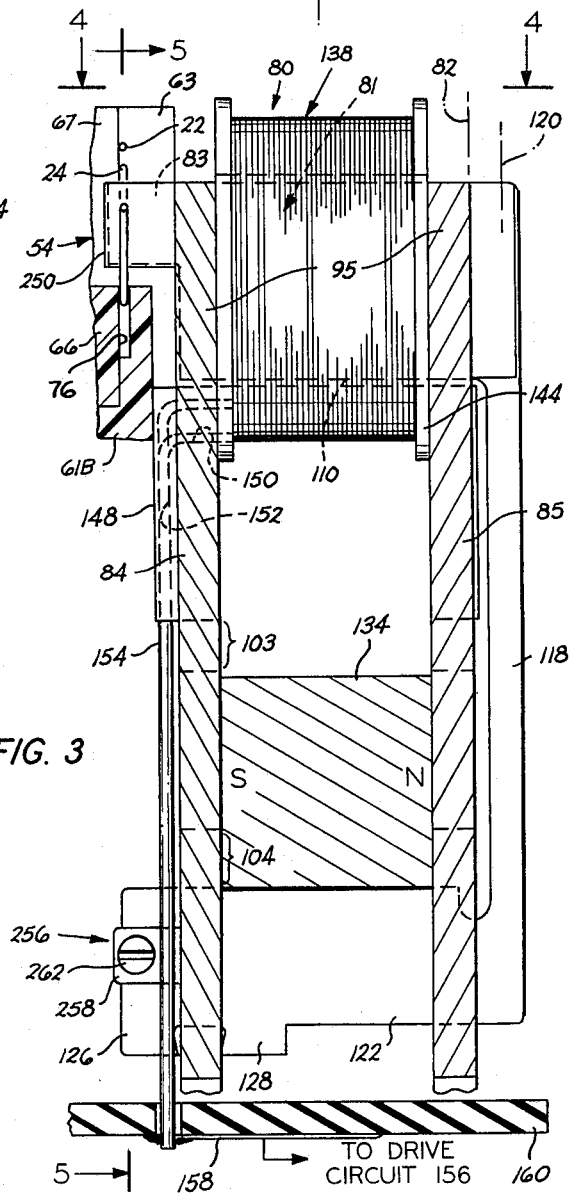
FIG. 3

ACTUATOR MECHANISMS FOR WIRE MATRIX PRINTERS

INTRODUCTION AND BACKGROUND

This invention relates generally to actuator mechanisms and more particularly to a compact, rapidly operating and economical arrangement of print wires and actuating mechanisms therefor in a wire matrix printer. The invention also relates to certain features of actuator mechanisms and has particular utility in the selective movement of workpieces such as the print wires, found in wire matrix printers.

Matrix printers of various designs have been known for many years. Typical printers generally related to this invention are disclosed in P. A. Brumbaugh et al. U.S. Pat. No. 3,672,482; A. S. Chou et al. U.S. Pat. No. 3,592,311; E. B. Finnegan U.S. Pat. No. 3,627,096; R. S. Bradshaw U.S. Pat. No. 3,217,640; W. Wockenfuss et al. U.S. Pat. No. 2,683,410; and K. A. Knutsen U.S. Pat. No. 2,869,455; all incorporated by reference hereinto. Moreover, a copending patent application in the name of J. L. DeBoo et al., Ser. No. 468,046, filed May 8, 1974 and assigned to the same assignee as the present invention, is related hereto and is also incorporated by reference herein. Specifically, the actuator mechanisms described and claimed herein are intended to be alternatives to the electromagnetic actuator mechanisms described in the last-named application. The actuator mechanisms of this invention and of J. L. DeBoo et. al. are intended to be interchangeable, one with the other, in a wire matrix printer.

In various ones of the prior art matrix printers, a column of vertically spaced print wires is usually mounted on a carriage and traversed across the surface of a recording medium or surface, such as paper. In a typical printer using a 5 × 7 dot matrix for printed characters, the vertical column of seven print wires travels across the recording medium surface, five-positions-(or printing steps)-to-the-complete-character. At each possible printing position, selected ones of the print wires (from zero to all seven) are actuated or "fired" to impact or drive a printing end thereof against both an inked ribbon (or other marking medium) and the recording medium in a printing pattern based on which wires are actuated. Also, the selected wires may otherwise mark the recording medium in any known fashion such as by punching holes therethrough.

This invention, then, seeks to improve such matrix printers (1) by providing a rapidly operating, very light, compact, inexpensive, easy to make print head and print wire assembly, particularly one with essentially straight print wires, and (2) by providing very small, efficient, compact, easy-to-assemble and extremely rapid actuating mechanisms for operating such print wires. The invention also concerns a new and improved actuator, having general utility in selectively moving workpieces, but especially useful in selectively reciprocating an array of closely spaced parallel workpieces, such as the print wires of a matrix printer.

This invention is also concerned with an improved actuator mechanism of the general class disclosed in W. J. Zenner U.S. Pat. No. 3,056,546 and G. Dirks, U.S. Pat. No. 2,976,801 both incorporated by reference hereinto.

The Zenner patent relates to a punch system, including a combination of spring reeds and electromagnets for operating the reeds, to selectively cock and fire the reeds and associated punch elements. The present invention relates to improved actuators of the Zenner type wherein potential energy is stored in a spring-like member, which improved actuators are small, compact, and low in electrical power consumption.

The present invention, moreover, is also concerned with improved magnetic actuator structures of the general class disclosed in the Dirks patent. The Dirks patent relates to a dot printing system which includes a plurality of print levers having printing surfaces thereon. The levers are continuously reciprocated at a point intermediate the ends of the levers. Both ends of each print lever are attracted and held by permanent magnets. One of the permanent magnets also includes an electrical coil which, when energized, neutralizes the magnetic flux thereof. The relative strengths of the permanent magnets are such that if a particular neutralizing coil is not energized, reciprocation of its associated lever effects movement of the print end of that lever away from its magnet to cause printing. If the coil is energized, reciprocation of the lever moves only the non-printing end of that print lever away from the magnet and printing does not occur. The present invention involves an improvement and simplification of Dirks type actuators by eliminating the continuous reciprocation and one permanent magnet and simplifying other structural elements.

Actuators of the Zenner type as well as other actuators, such as those of the Brumbaugh et al. and Chou et al. patents rely on converting the potential energy stored in a reed or leaf spring to kinetic energy of a print wire to effect printing. Accordingly, another object of this invention is to improve on that concept by using a torsion spring rather than a reed. Simply stated, a torsion spring presents two advantages over a leaf spring. First, in a torsion spring, the storage of potential energy is accompanied by a uniform deformation. This means that other factors (material, size) being roughly equal, the torsion spring is capable of storing more potential energy per maximum stress more efficiently and in a more compact manner with potentially less movement than a leaf spring. Second, in a torsion spring, a mass to be driven thereby is essentially divorced from the spring. This is not true with a leaf spring wherein a significant part of the mass driven is the spring itself. The larger mass of a leaf spring renders it slower in driving an object, such as a print wire. Thus this invention uses these advantages or torsion springs to achieve a compact, efficient, high speed print head.

This invention further relates to the construction and geometry of actuator mechanisms which include pole pieces and armatures and to circuit operating principles for such actuator mechanisms and also relates to such actuator mechanisms which use a compact and low mass assembly of permanent magnets, pole pieces, armatures, and coils.

SUMMARY OF THE INVENTION

With the foregoing and other objects in view, the present contemplates an improved actuator of a type useful in matrix printers, but having more general utility. Specifically, the improved actuator is of the two-position variety having an armature attracted to a first position by a magnet. This attraction stores potential energy in a resilient member against which the attraction is effected. The stored potential energy tends to move the armature to a second position.

The actuator includes an electric coil which, when a voltage is applied thereto, neutralizes or conteracts the field of the magnet to permit the resilient member to move the armature to the second position.

In the improved actuator of this invention, the resilient member is a torsion spring on which the armature is mounted for rotation. Also the magnet is a permanent magnet which normally attracts the armature to the first position whenever the voltage is not applied to the coil. Moreover, the coil is so positioned that it surrounds the armature, but does not mechanically load the armature.

A preferred use of the improved actuator is the moving of a print wire in a printer to impact the wire on a recording medium upon movement of the armature.

More specifically, the present invention comtemplates a wire matrix printer in accordance with certain features of this invention including the improved actuator.

Specifically, a print head having one or more banks each containing a plurality of substantially straight print wires of uniformly varying length and a plurality of the improved actuators is provided. The print wires, seven in a typical example, are vertically spaced in the banks essentially parallel to each other. Printing or inner ends of the wires in a given bank lie in a substantially vertical column for linear reciprocation along spaced, parallel, and essentially horizontal, printing axes for impact against a recording surface. The outer or actuator ends of the wires, which are actuated or driven ("fired") by the improved actuators, are in a vertically stepped and spaced array and are also spaced horizontally. The print wires are arranged in an array in which the lengths of the wires vary in accordance with the distance of each wires's driven end (and of its respective actuator mechanism) from the recording medium such as paper comprising the recording surface.

Preferably, the print wires are mounted to and actuated by the armatures of the improved actuators. One of the ends of each armature pivots or rotates about the armature's axis of rotation toward and away from a first pole piece; the armature is mounted to the torsion spring at or near the rotation axes. In a preferred embodiment the spring is elongated and the rotational axis and the major axis of the torsion spring coincide or nearly do so, both axes being at or near a second pole piece. Means are provided for coupling the driven ends of each print wire to the pivotable end of its armature so that each print wire reciprocates linearly upon movement of the armature. A preferred way of connecting the print wires and the armatures is disclosed.

In accordance with another feature of the invention each torsion spring is connected by an integral locator bar to both pole pieces in the bank to rotatably mount the armature. The second pole piece serves as a rotational pivot or fulcrum for each armature. When the pole pieces are unmagnetized, the armatures assume a neutral position overlying their locator bars whereat the pivotable end thereof is separated from the first pole piece. Association of a single permanent magnet with the two pole pieces of a bank attracts the pivotable armature ends to distort the torsion spring and to hold such armature end next to the first pole piece against the action of the torsion spring in which the potential energy is now stored. This is the rest or normal position of the armature whereat the print wires are maintained away from the recording surface.

Means, such as the electric coil, are provided which, upon energization, selectively counteract, neutralize or cancel the magnet flux of the permanent magnet in the armature of one or more actuator mechanisms. Such counteracting or neutralizing of the magnetic flux permits the stored potential energy in the torsion spring to pivot the aramture end away from the first pole piece on the fulcrum provided by the second pole piece and toward the recording medium. Such movement effects the impact of the printing end of the print wire with an inked ribbon which prints a dot on the paper.

In the preferred embodiment such impact occurs as the aramture occupies the neutral position. Upon deenergization of the neutralizing means, both the magnetic field of the permanent magnet acting through the pole pieces and the rebound of the printing end from the ribbon and paper cooperate to return the armature and the driven wire end to their rest position abutting the first pole piece.

Various features of the construction, mounting and geometry of the armatures, pole pieces and magnet are of significance in the preferred form of the present actuator mechanism in obtaining a compact, powerful, and rapid actuating actuator mechanism which is inexpensive and simple to manufacture. Such advantages rest primarily on the use of the torsion spring, the beneficial characteristics of which have been noted above.

In accordance with additional features of the present invention, the neutralizing means may comprise the electrical coil which is wound on one or both of each pair of pole pieces at the position of a particular armature, or preferably about the armature itself. In the preferred embodiment the armature is not mechanically "loaded" by the coil. Further, in a preferred form of this invention the pole pieces in each bank of armatures are two in number, each having a series of upstanding projections, pairs of which are associated with particular armatures. Flux isolation slots or cut outs are provided in each pole piece to prevent the neutralizing action of the neutralizing means, which initiates the movement of one armature, from undesirably affecting the operation of adjacent armatures.

Moreover, a unique guide structure for the print wire is provided to accurately guide them during printing.

DRAWINGS

FIG. 3 is a vertical section along line 3—3 of FIG. 2 illustrating the rear of one of a plurality of actuators of the print head of this invention and a portion of a guide structure for plural print wires operated by the actuators;

Figure 1:
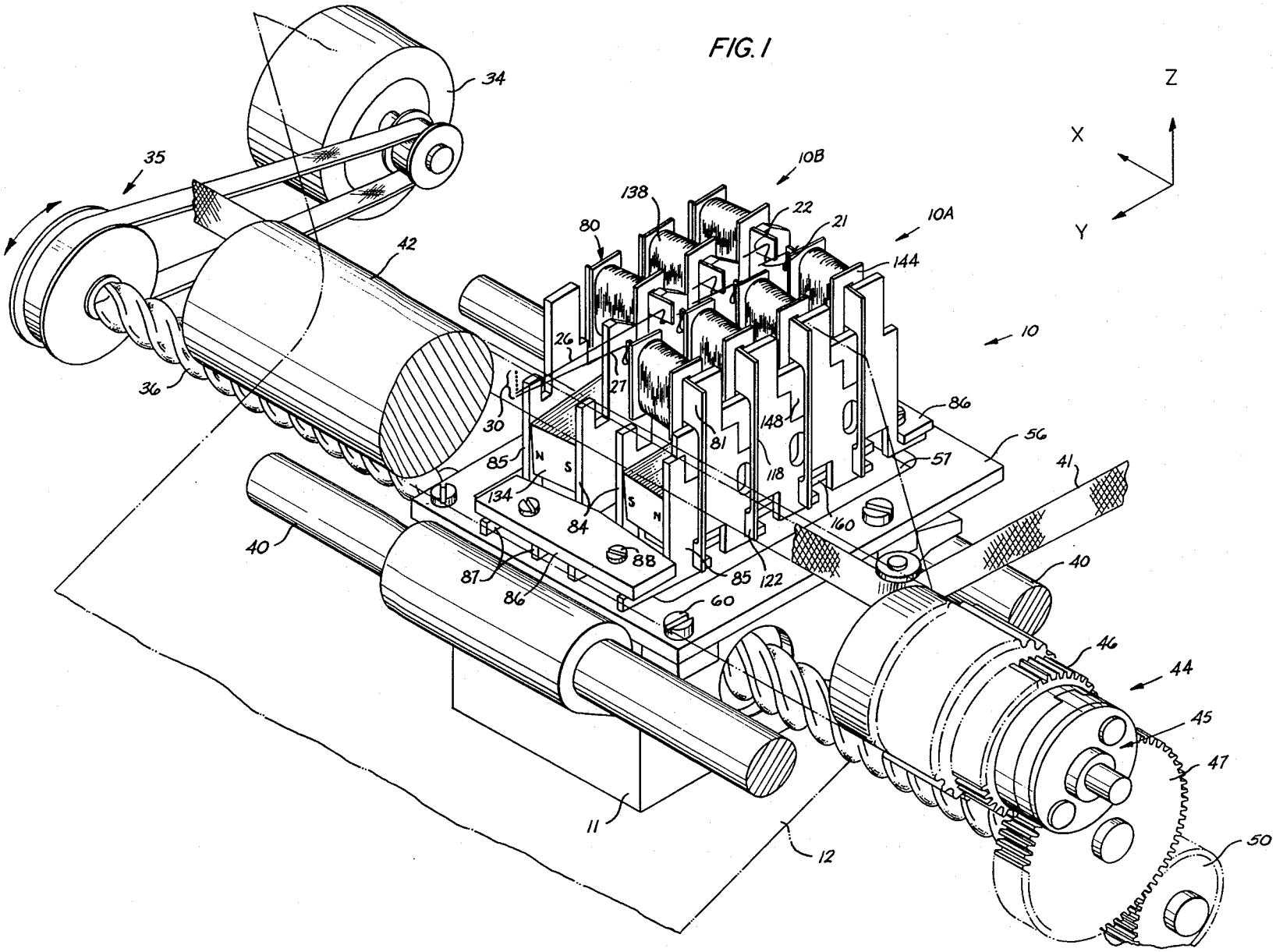
FIG. 1 is a perspective view of a portion of a wire matrix teleprinter, in accordance with the present invention, viewed from a paper or other recording medium and looking toward an operator's position and at the front of a print head according to this invention.
Figure 2:
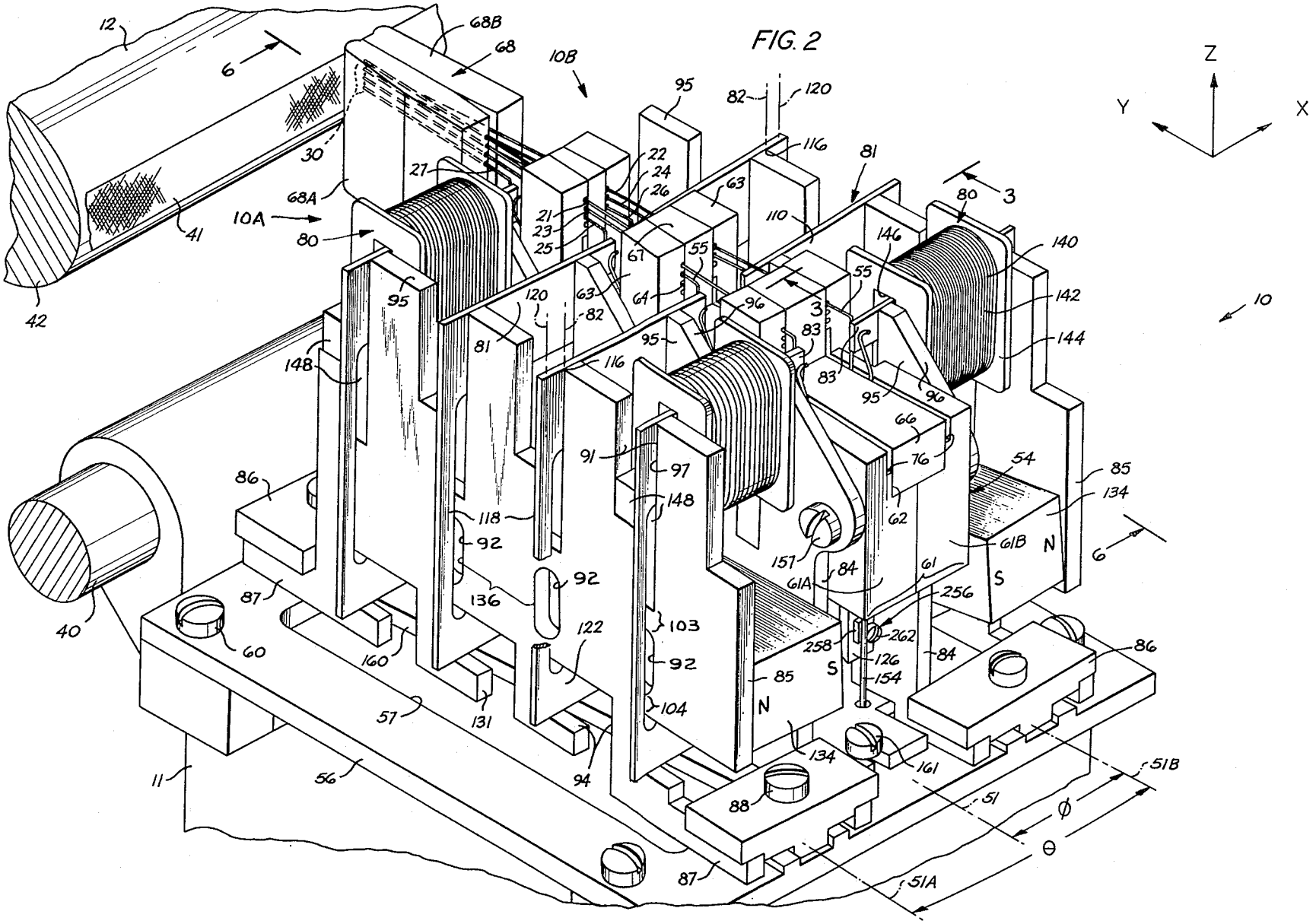
FIG. 2 is an enlarged fragmentary perspective view of a portion of the print head used in the teleprinter of FIG. 1 according to the present invention, viewed from the operator's side (the upper right in FIG. 1)
Figure 6:
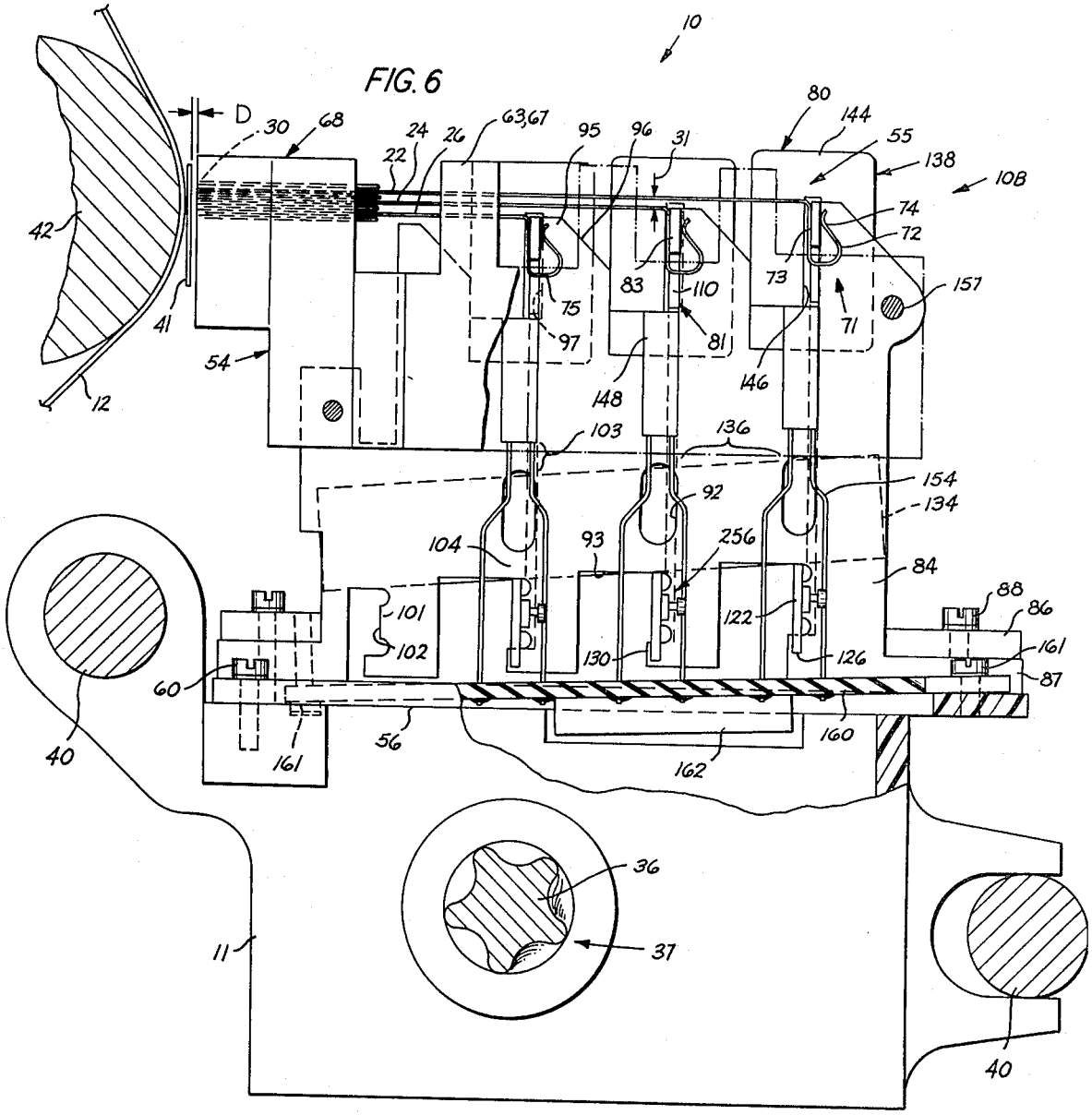
Figure 14:
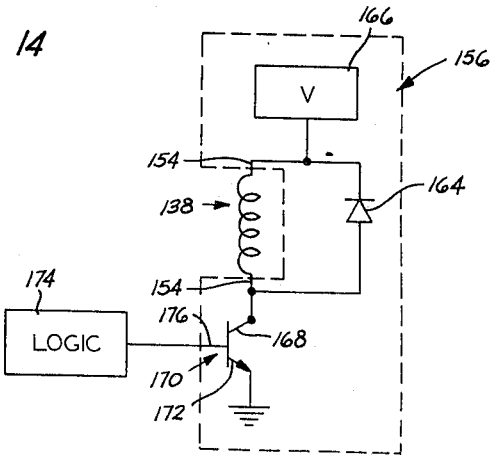
Figure 8:
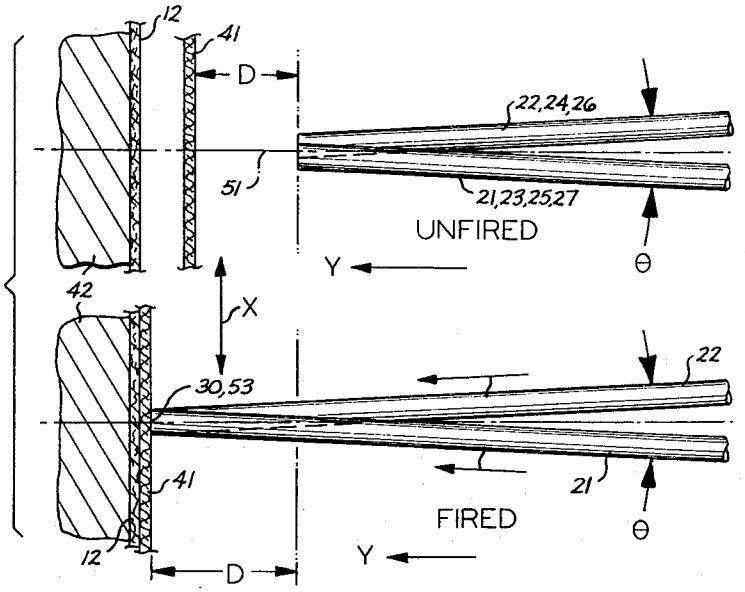
Figure 9:
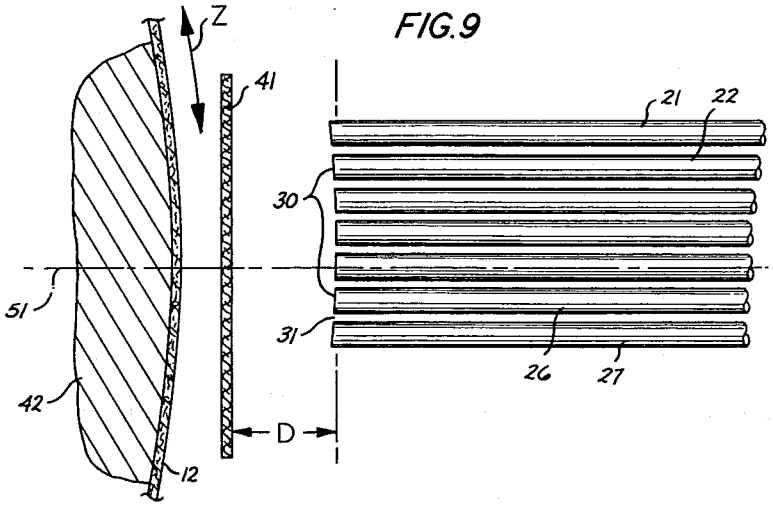
Figure 7:
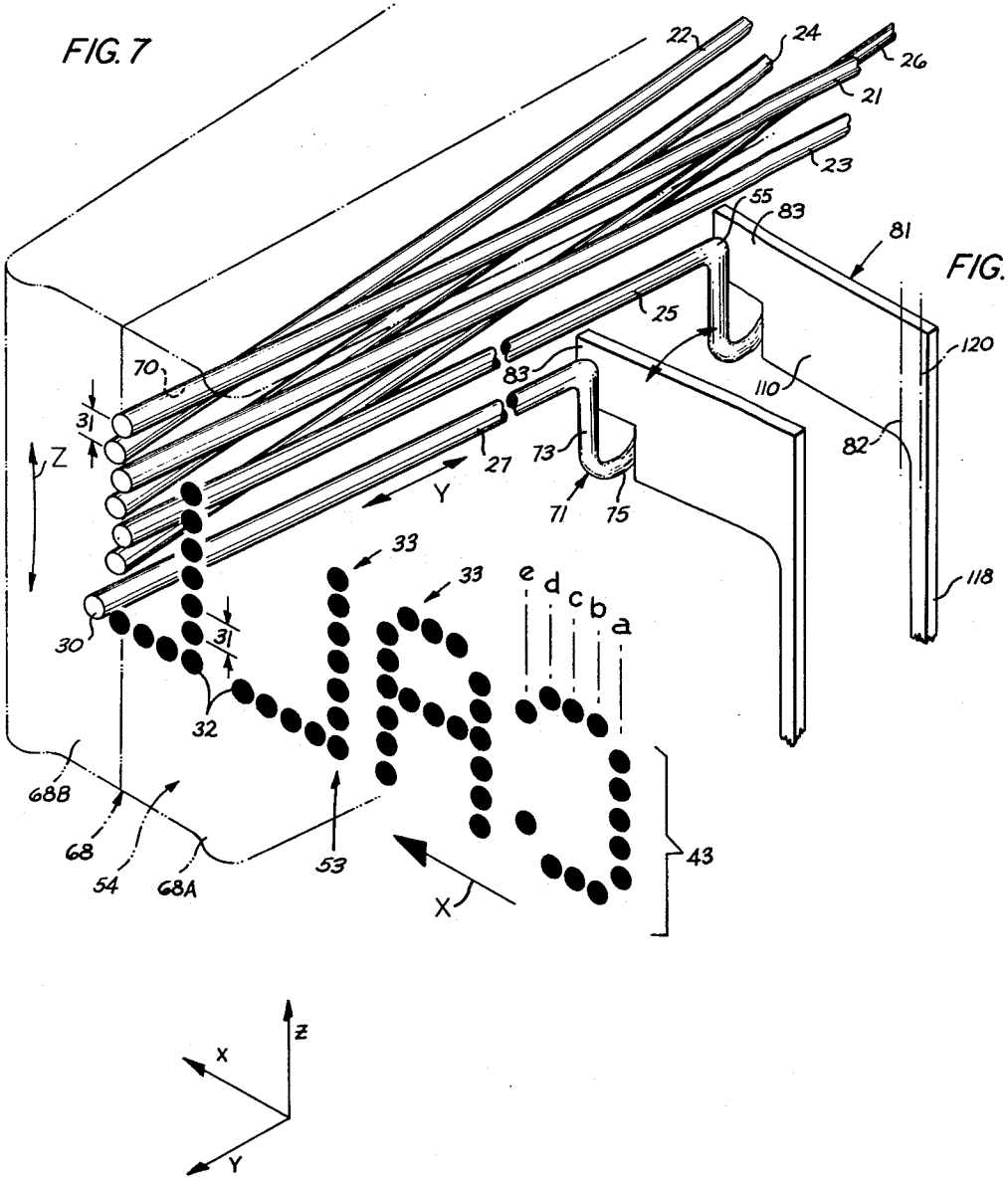
Figure 15:
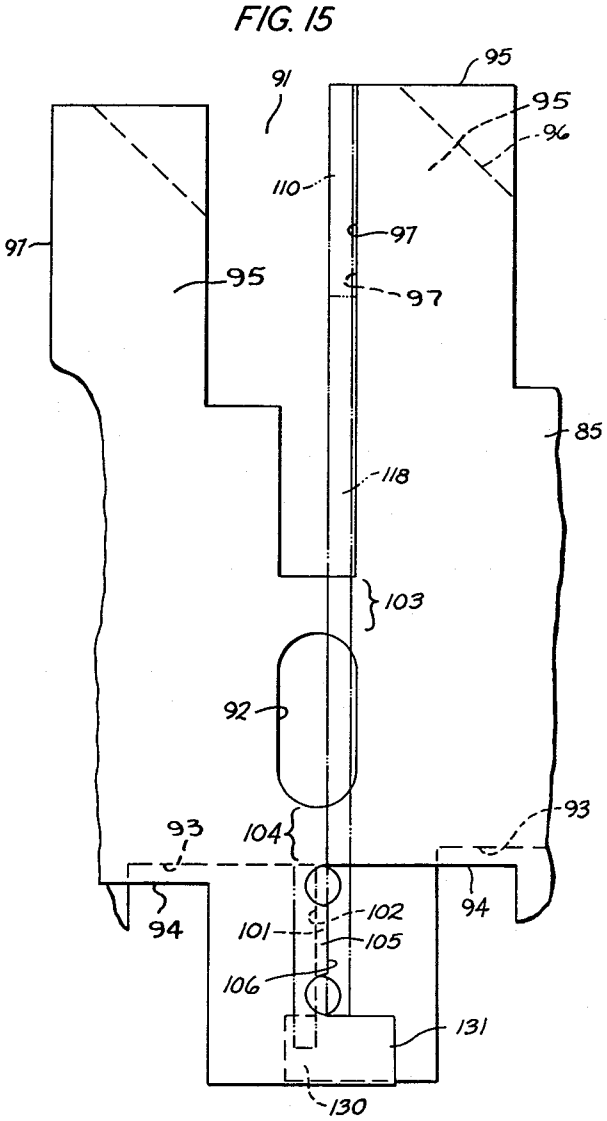
Figure 10:
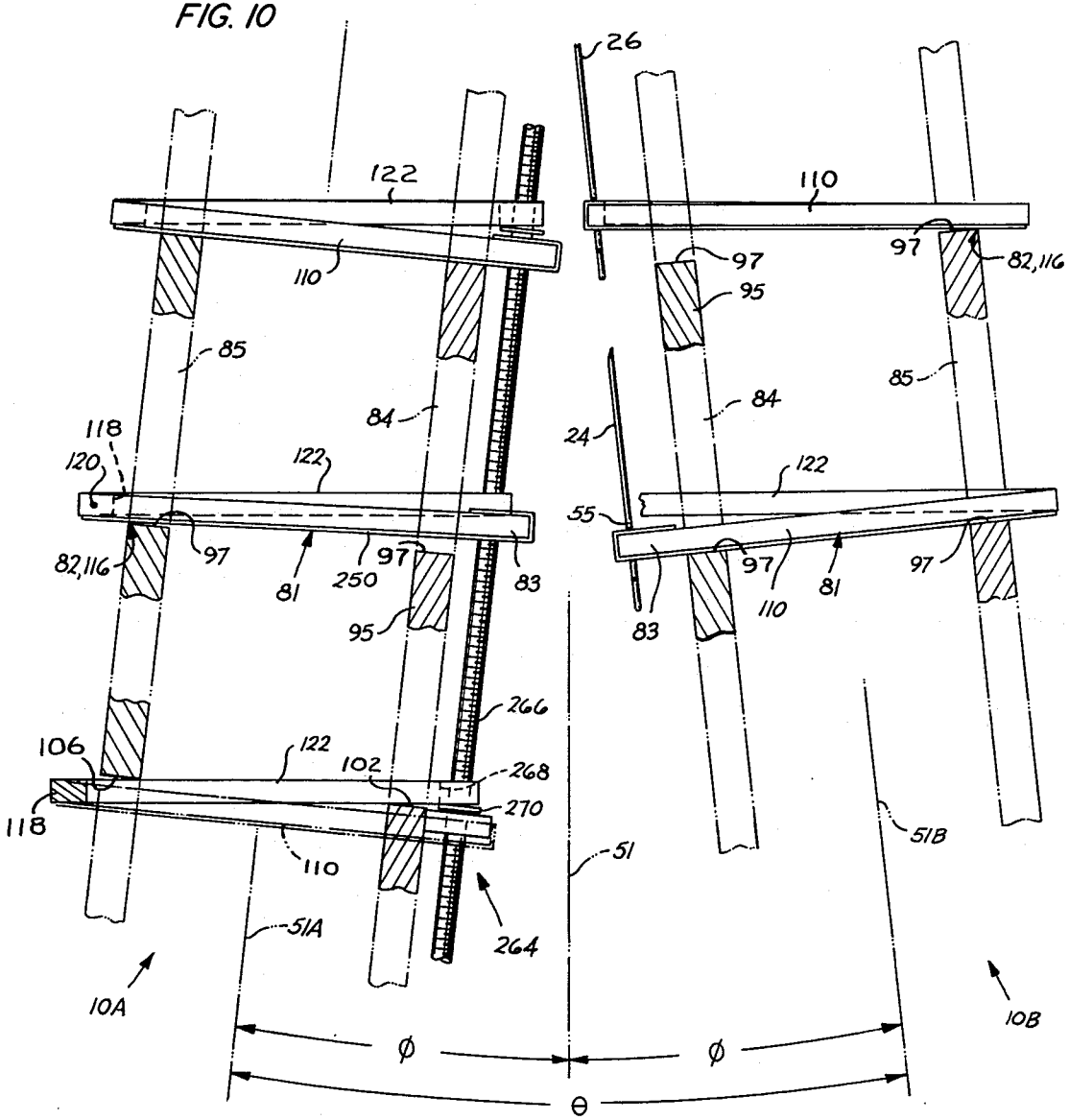
Figure 12:
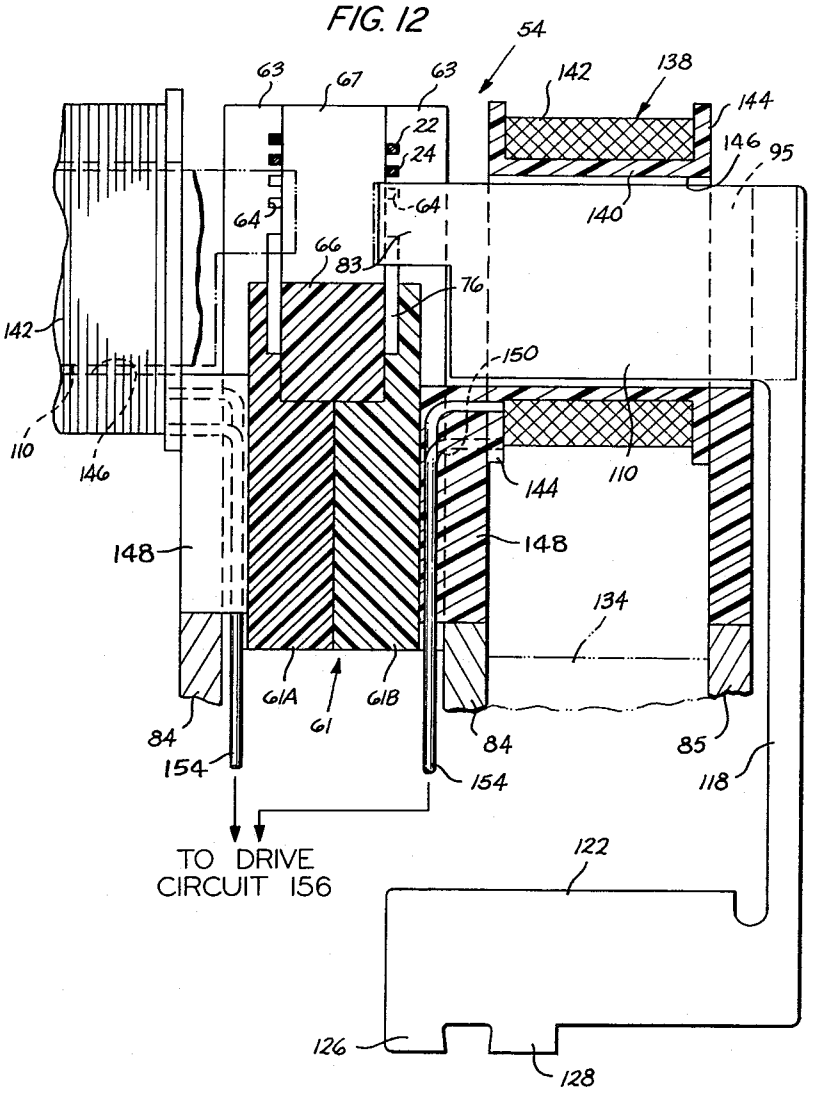
Figure 11:
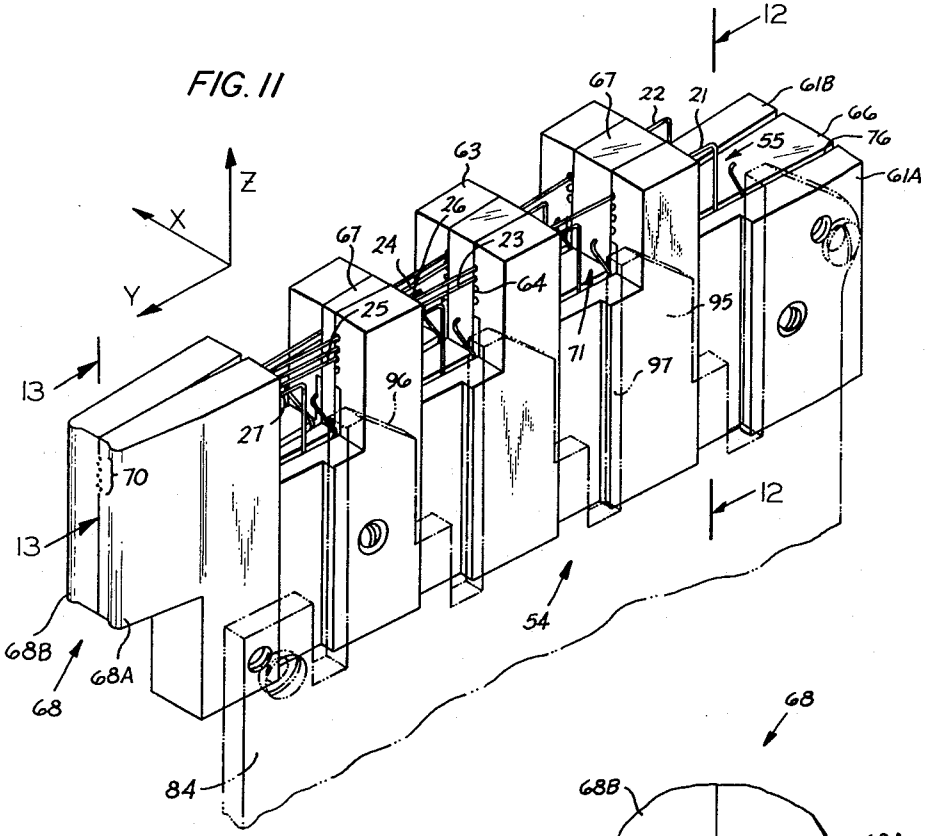
Figure 13:
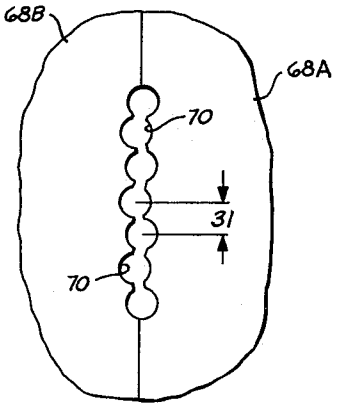

FIGS. 4 and 5 are a top and a side view, respectively, of FIG. 3 taken along lines 4—4 and 5—5 of FIG. 3 and showing two adjacent actuators of the print head;

FIG. 6 is a vertical elevation along line 6—6 of FIG. 2 showing the geometry and relationship of a bank of the actuators of FIGS. 3–5 their associated print wires, and the guide structure therefor according to this invention;

FIG. 7 is schematic, fragmentary perspective view (not to scale) of the print wires depicted in FIGS. 3—6 and a portion of the actuators therefor, illustrating some of the basic principles of wire matrix printing, including typical matrix characters printed according to the present invention;

FIGS. 8 and 9 depict in greater detail the geometry of printing ends of the print wires shown in FIG. 7 and their relationship to other parts of the teleprinter of FIG. 1, wherein FIG. 8 is a top view of the print wires in an unfired and a fired state, and FIG. 9 is a side view of the wires in an unfired state;

FIG. 10 is a schematic, fragmentary (not to scale) top view of several armatures of the actuators of FIG. 2 similar to FIG. 4, showing both rest positions and fired positions of the armatures and their associated print wires;

FIG. 11 is a perspective view of the guide structure for the print wires of the print head shown in part in FIGS. 3–6 viewed from the same general perspective as in FIG. 1 in which the guide block is not shown;

FIG. 12 is a sectional view taken along the line 12—12 of FIG. 11 showing additionally portions of the actuators of the present invention similar to FIG. 3;

FIG. 13 is a front view taken along line 13—13 of FIG. 11;

FIG. 14 is an electrical schematic illustrating a circuit for operating the actuators of this invention; and FIG. 15 is a partial, detailed, side elevation of pole pieces for the actuators of the present invention.

DETAILED DESCRIPTION

General Printer Structure

FIGS. 1–5

Referring first to FIGS. 1, 2 and 6, a wire matrix printer is illustrated which includes a print head 10 in accordance with one preferred embodiment of this invention. Except for the print head 10 of the present invention, other details of the printer structure as shown in FIGS. 1 and 4 may be the same as those disclosed in the aforementioned application of J. L. DeBoo et al. In fact, the print heads 10 of both inventions are intended to be interchangeable with each other.

The head 10 is mounted on a conventional carriage 11 for linear traversing movement in a horizontal direction (designated X) across a record medium, such as a paper 12 on which printing or other marking or punching is to take place. As viewed in FIGS. 1, 7, 11 and 13, the print head 10 travels from right to left during printing, similar to certain conventional typewriters and then returns from the left to the right after each line has been printed on the paper 12. In FIGS. 2, 3, 4, 10 and 12 which are all viewed from the operator's perspective, the print head 10 moves from left to right during printing. When the terms "left" and "right" are used hereafter they refer to the perspective of FIGS. 2 et al.

The print head 10 includes a plurality of print wires 21–27, seven being illustrated in FIGS. 1–5, 7–9, 6 and 11 for a conventional 5 × 7 dot matrix. Printing, free or inner ends 30 of the print wires 21–27 are equally spaced vertically, as shown at 31, in FIGS. 7 and 9 to print successive vertical columns a–e of dots 32 (FIG. 7) on the paper 12 as necessary to form selected characters 33 or other information or data thereon. As is well known in the matrix printer art, the print wires 21–27 are selectively actuated as the head 10 traverses the paper 12 to form the characters 33 via a matrix (columns *a–e*) of the dots 32. When the head 10 contains a single column of the seven print wires 21–27, the traversal of the carriage 11 and the head 10 provides the Z dimension of a conventional 5 × 7 dot matrix, as is well known, and the vertical print wire spacing 31 provides the Z (height or vertical) dimension (FIGS. 7 and 9) of the characters 33. If lower case letters are to be printed, or if other more complex characters or patterns are to be formed, then 7 × 9 or even larger matrices are used, for example, by adding two or more print wires to the wires 21–27 of the print head 10.

Returning to FIGS. 1, 2, 4 and 6, the carriage 11 continuously traverses the paper 12 in the X or printing direction by a reversible, constant speed, drive motor 34, which may turn a belt and pulley transmission 35 to rotate a conventional helical lead screw 36 on which the carriage 11 is threadedly mounted by a carriage nut 37 (FIG. 6). Preferably, the carriage nut 37 is the type described in commonly assigned patent application of Arthur F. Lindberg, Ser. No. 468,047, filed on May 8, 1974, incorporated hereinto by reference now U.S. Pat. No. 3,945,481, issued Mar. 23, 1976. Alternatively, the carriage 11 may be driven in step-by-step fashion across the paper 12 with the print head 10 stopping at each possible printing column *a–e* during its traversal across the paper 12. The carriage 11 is mounted for linear reciprocation in the X direction on a pair of guide rods 40 (FIGS. 1 and 4), and is reciprocated by the drive motor 34 between the left-hand start-of-line (extreme right of FIG. 1) and the right-hand end-of-line (extreme left of FIG. 1) positions in a generally conventional fashion.

As the print head 10 travels across the paper 12 in the X or printing direction past each possible printing position, such as *a–e* in FIG. 7, selected ones of the print wires 21–27 are fired or actuated "on-the-fly" to print a column *a–e* of from zero to seven vertical dots 30. As best depicted in FIGS. 4 and 5, the firing or actuating of a wire 21–27, that is, a wire selected to effect printing, is accomplished as follows: The selected wire 21–27 is driven a short distance D (FIGS. 8 and 9) in the horizontal direction Y (perpendicular to both X and Z and to the paper 12) thus impacting the printing end 30 of the selected wire or wires 21–27 against a type ribbon 41 and further driving the ribbon 41 and superjacent portions of the paper 12 against a backing member or platen 42 in a well known manner.

When a desired length of a line 43 of characters 33 has been printed, or when the end-of-line position is reached, the carriage 11 is returned to the start-of-line position and the paper 12 is stepped upwardly one or more character lines 43 (See FIG. 7) in the Z direction, as in a conventional typewriter. Preferably, this is done automatically by a line feed mechanism 44 in preparation for the printing of following lines 43. While any known line feed mechanism 44 may be used in accordance with the present invention, one preferred mechanism 44 is that set forth in commonly assigned copending application of Ingard B. Hodne, Ser. No. 468,048, filed May 8, 1974 and incorporated hereinto by reference now U.S. Pat. No. 3,935,938, issued Feb. 3, 1976. Generally, the line feed mechanism 44 includes a coupling or clutch 45 responsive to a line feed signal which positions a platen gear 46 enmeshed with a speed reduction gear 47 for a preset time interval during carriage return from the end-of-line position to the start-of-line position to rotate the platen 42 and to step the paper 12. The gear 47 in turn is driven by drive gear 50 mounted on the lead screw 36 as shown in FIG. 1.

Various other arrangements for effecting relative movement of the print head 10 and the paper 12 may be utilized. For example, in printing the lines 43, the platen 42 may be rotated and the paper 12 stepped a desired number of lines 43 at the end-of-line position of the head 10 and the next line 43 may be printed on the return stroke while the carriage 11 is moving back to the start-of-line position. Moreover, to print graphs or other patterns generally referred to as "plotting," the platen 42 may be "rolled" (selectively moved up and down) independently of movement of the carriage 11 by appropriate incoming data signals via circuitry (not shown) connected to the drive motor 34 to provide a variable dimension to the graph or pattern. Moreover, the carriage 11 may be independently movable by a "slide-on-slide" arrangement such as by using a linear electric motor of the type shown in A. G. Wallskog U.S. Pat. NO. 3,696,204, or G. Cless U.S. Pat. No. 3,688,035. Other details of the carriage 11 and other portions of general printing mechanisms and operating circuits are not critical to the present invention and may be arranged as described in Brumbaugh et al. patent as well as the other matrix printer patents previously cited.

In commonly assigned copending application of Richard E. LaSpesa, Ser. No. 468,049 filed on May 8, 1974, and incorporated by reference hereinto, now U.S. Pat. No. 3,894,232, issued July 8, 1975, there is disclosed an optical sensor for generating time pulses to synchronize printer operation in response to an encoder wheel mounted on the shaft of the drive motor 34 and a mechanism for precisely setting the angular position of the sensor with respect to the code wheel. Such a sensor may be utilized with the present invention.

Print Head 10

General Arrangement of the Print Wires 21–27

Referring now to FIGS. 1–9 and 11 and especially FIGS. 2 and 5–9 there is shown a preferred layout of the print wires 21–27 in accordance with certain principles of this invention.

In a preferred embodiment, the print head 10, is divided into two halves or banks 10A and 10B, left and right banks, respectively, as viewed in FIG. 2. The print wires 21–27 are preferably divided as equally as possible between the two banks 10A and 10B. Center lines 51A and 51B of the banks 10A and 10B (FIGS. 2, 8 and 10) are angularly separated by an angle $\theta$, which in the described example is about 5°, although other angular spacing may be used. The center lines 51A, 51B, are in turn angularly separated by an angle $\phi$ from the center line 51 of the head 10 leaving a wedge-shaped space between the banks 10A and 10B. $\phi$ is about 2½° in this example. The center line 51 lies on a common plane with the Y direction and is mutually perpendicular to both the X and Z direction as well as to an impact line 53. The impact line 53 (FIG. 7) is the curved line which could be drawn between the printing ends 30 of the wires 21–27, should all be fired, where such printing ends 30 impact on the ribbon 41 (lower part of FIG. 8) in printing the columns *a–e*.

The print wires 21, 23, 25, 27 are contained in and actuated by the left bank 10A and the print wires 22, 24, 26 are contained in and operated by the right bank 10B, although the reverse arrangement may also be used. The free ends 30 of the wires 21–27 are alternately interleaved as shown in FIGS. 1, 2, 5 and 11 immediately adjacent to the impact line 53.

Of course, a single bank or more than two banks may be used, if desired. In the former, no interleaving would be necessary; in the latter cyclic alternate interleaving would preferably be used.

The printing ends 30 of the print wires 21–27 are immediately adjacent and slightly separated from the impact line 53 when all of the wires 21–27 are unfired. Such ends 30 are arranged in a spaced, vertical arrangement which is an almost perfectly vertical, slightly staggered column, as shown in FIGS. 7, 8 (top) and 13. At the impact line 53, assuming all of the wires 21–27 are fired, a perfectly vertical column of their printing ends 30 is formed (FIG. 1 and the lower part of FIG. 8). The staggering in the unfired state is due, of course, to the angular relation of the banks 10A and 10B, and to the fact that when the wires 21–27 are unfired, a small distance D (FIGS. 6 and top of FIG. 8) exists between the printing ends 30 and the ribbon 41. The distance D may vary from 0.010 to 0.060 inch and is typically 0.035 inch within this range.

Specifically, the printing end 30 of the topmost wire 21 as seen in FIGS. 2 and 8 (top) (FIGS. 8 and 14, and as viewed from the paper 12) and the end 30 of every other odd-numbered wire 23, 25, and 27 is slightly to the left of the center line 51, while the ends 30 of the even-numbered print wires 22, 24, and 26 are slightly to the right thereof. The same staggering is shown in FIGS. 7, 11 and 13, but as viewed from the paper 12 so that, of course, left and right are reversed. As viewed from the top in FIG. 8, the print wires 21–27 converge through the included angle $\theta$ (approximately 5 degrees, although this angle may be adjustable) toward the impact line 53.

As shown in FIG. 7, the printing ends 30 of the wires 21–27 immediately adjacent the impact line 53 may be machined to conform precisely to the curvature of the platen 42 as shown from the side in FIG. 9. Moreover, as viewed in FIG. 8, the wire ends 30 may be machined so that such ends are parallel to the platen 42.

In any event, when one or more respective print wires 21–27 are actuated or fired, the wire moves forward toward the platen 42 impacting the printing end 30 flatly against the ribbon 41, and sandwiching the paper 12 between the ribbon and the platen 42 along the impact line 53, the ends 30 of any actuated print wires 21–27 precisely conforming to the surface of the paper 12 held on the platen 42.

In a preferred embodiment, the wires 21–27 are fabricated of music wire, or the like, approximately 0.013 inch in diameter. The print wires 21–27 are, accordingly, relatively stiff and can be readily reciprocated short distances in the Y direction to print characters without significant distortion or bending.

Distortion or bendng of the wires 21–27, as well as any attendant lack of registration between the printing ends 30 and the impact line 53, may also be obviated by a guide block 54 associated with the left and right-hand banks 10A and 10B of the print head 10 as shown in FIGS. 2–6 and 11 and as discussed in detail below. For simplicity, the guide block 54 is not shown in FIG. 1. Further, the guide block although preferably present is not absolutely necessary, depending on the stiffness and other characteristics of the material constituting the wires 21–27. For example a simple guide (not shown) at or near the printing ends 30 may suffice to vertically support and guide the wires 21–27.

The diameter and the vertical spacing 31 (for example, 0.016 inch center to center) of the wires 21–27 are both dictated by the dot 32 size and the vertical spacing 31 desired in the printed characters 33. In the specific operating embodiment of the present invention, adjacent print wires 21–27 are vertically spaced 31 by approximately 0.016 inch center-to-center at the printing ends 30, and by twice that amount (0.032 inch) in the banks 10A and 10B.

The wires 21–27 are of generally uniformly increasing lengths proceeding upward from the bottom wire 27 to the top wire 21 in the bank 10A and from the bottom wire 26 to the top wires in the bank 10B as shown in FIGS. 1, 2, 6 and 11. This arrangement, as well as the vertical spacing 31 of the wires 21–27, effects a horizontally-spaced, vertically stepped and spaced configuration of actuator, fired or outer ends 55 of the wires 21–27. In this example, the wire lengths vary uniformly from about 0.750 inch for the bottom wires 27 and 26 in the respective banks 10A and 10B to 2.250 inches for the top wires 21 and 22, again in the respective banks 10A and 10B. This straight, parallel, horizontal wire configuration with the horizontal spacing and vertical spacing and stepping at the outer ends 55 achieves a compact, light, and economical print head assembly of closely spaced print wires, according to the invention. Because the wires 21–27 are required to reciprocate only the very short distance D in the Y direction, the wire lengths are made as short as practically obtainable.

Guide Block 54

For simplicity, the guide block 54 is not shown in FIG. 1. However, referring to FIGS. 2, 3, 6, and 11, the wires 21–27 may be periodically supported along their lengths and at both their inner or printing ends 30 and their outer or actuator ends 55 for precise horizontal reciprocation by the guide block 54 which is associated with both banks 10A and 10B. The block 54 is made of DELRIN or other rigid, low friction material and may be mounted to a mounting frame 56 or to the banks 10A, 10B (the latter being preferred), in any convenient manner. Other elements of the head 10 are also mounted to the frame 56 which has a central cutout 57 for servicing the head 10 from below and through which pass certain electrical connections as explained more fully below. The frame 56 in turn, is mounted to the carriage 11. Typically, this latter mounting may be effected by a plurality of screws 60 as shwon in FIGS. 1, 2 and 6. Also, the spring-arm-flange arrangement of the aforementioned Deboo et.al. patent (elements 160–163) may be used if desired.

The guide block 54 includes a pair of similar, horizontal, elongated members 61A and 61B. The members 61A and 61B are fastened together at their forward ends (in the Y sense) and separated at their rearward ends to form a wedge 61 having a wedge-shaped opening therein. The fastening of the members may be by any convenient means, e.g. a screw, or the wedge 61 may be made, as by molding, in one piece. The wedge 61 occupies the space between, and extends at least the length of, the bands 10A and 10B. The wedge 61 subtends an angle equal to $\theta$ or about 5°. Formed integrally with the members 61A and 61B are a plurality of upstanding finger-like guides 63 aligned in pairs in the X direction one guide 63 in each pair being respectively on the members 61A and 61B. The guides 63 on each member 61A and 61B are aligned along a line parallel to the respective axes 51A and 51B. The guides 63 contain a plurality of parallel, horizontal vertically spaced grooves 64 formed therein either during molding thereof or by a material removal operation. The grooves 64 may assume any desired cross-sectional configuration (a rectangular one being shown) which constrains wires 21–27 therein both vertically and laterally. As viewed from the rear (FIGS. 3 and 12) corresponding grooves 64 in the guides 63 on one or the other side of the wedge 61 are aligned. That is, the topmost groove 64 in all the guides 63 on the one member 61A are aligned horizontally. In the example shown, as viewed in FIGS. 3 and 12, the guides on the right member 61B of the wedge 61 have three grooves 64, and guides 63 on the left member 61A have four, corresponding, of course, to the number of print wires 21–27 in the respective banks 10A, 10B.

The outer ends 55 of the wires 21–27 are vertically stepped, as shown in FIGS. 5, 6 and 10, and such ends 55 are horizontally spaced from each other in the Y direction. The guides 63 are formed to occupy these spaces. In the example shown, the guides 63 are about 0.500 inch apart.

The grooves 64 are at a height such that when the guide block 54 is mounted either to the plate 56 or directly to the banks 10A and 10B, the wires 21–27 are received therein, the topmost grooves 64 in the guides 63 of the left member 61A receiving the uppermost wire 21 of the left bank 10A, the topmost groove 64 in the guides 63 of the right member 61B receiving the uppermost wire 22 of the right bank 10B, etc. The wires 21–27 are constrained in their respective grooves 64 by a wedge-shaped closure 66.

The closure 66 may be elongated bar having a pluarlity of wedge-shaped, upstanding fingers 67 thereon, the entire closure 66 being entirely complementary in shape to the inside facing surfaces of the members 61A and 61B. Fingers 67 are so located that when the closure 66 is located between the right and left-hand guides 63 within the space 65 the fingers 67 mate with the guides 63 to close the grooves 64. The closure 66 may be attached to the wedge 61 by any convenient means such as screws or an adhesive.

With the closure 66 attached to the wedge 61 the wires 21–27 are periodically supported along their lengths at each guide 63. This support not only accurately positions the wires 21–27, but also obviates any sideways deflections of the wires 21–27 as their printing ends 30 impact on the ribbon 41.

It should be pointed out that the guide block 54 merely constrains the wires 21–27 to maintain the free, natural orientation and configuration they would normally assume without the block 54 except for external influences, such as deformation during a printing stroke and gravity. This is particularly true at the printing or free ends 30.

As pointed out in describing FIG. 1 (in which the guide block 54 is not shown) the free wire ends 30 assume an interleaved, nearly vertically aligned, slightly staggered configuration (FIGS. 7, 11 and 13). This configuration is maintained by an upstanding forward nib 68 attached to the front of the member wedge 61. The nib 68 is in two halves 68A and 68B formed respectively at the front of the members 61A and 61B. The nib 68 contains (in this example) seven bores 70 having exactly this staggered configuration at the very front of the finger 68 (FIG. 13) four of the bores 70 being respectively aligned with the grooves 64 in the guides 63 on the left member 61A and three of which are similarly aligned with the grooves 64 in the guides 63 on the right member 61B.

The wires 21–27 and the guide block 54 are preferably preassembled as in FIG. 11, this assembly then being associated with the rest of the print head 10 as described below.

ACTUATOR ENDS 55 OF THE WIRES 21–27

The outer or actuator ends 55 of the wires 21–27 are formed into loops 71 as shown in FIGS. 1–11, and especially in FIGS. 5 and 7. The loops 71 serve as tension mounts, described below, and also serve a guide function for the wires 21–27 in aid of the guides 63 and the finger 67.

The loops 71 are generally U-shaped, a rear leg 72 of the U running first toward a front leg 73 of the U and then from a bend 74 away from such front leg. A bridge 75 of the U interconnects the legs 72 and 73, the length of the leg 75 being greater than the distance between the legs 72 and 73 at the bend 74.

The bridge 75 and the lower, wider part of the front and rear legs 72 and 73 adjacent thereto are contained in and constrained by a channel 76 partly formed in the inside and top surfaces of each wedge 61A and 61B. The channels 76 are completed by the side surfaces of the closure 66 and reside between the guides 63 in the Y direction. Such constrainment of the loops 71 prevents both lateral displacement of the outer or driven ends 55 and rotation of the wires 21–27 on their major axes. The distance between the guides 63 and the fingers 67 is sufficient to permit enough movement of the loops 71 so that the wires 21–27 may travel the distance D.

Actuators - General

FIGS. 1–6, 10–15

As mentioned above, the print head 10 is divided into two banks 10A and 10B. Each bank has a number of actuators 80 for the wires 21–27. The left-hand bank 10A includes a plurality of actuators 80-1, 80-3, 80-5, and 80-7, which selectively fire the print wires 21, 23, 25 and 27, respectively, associated therewith. The right-hand bank 10B includes a plurality of actuators 80-2, 80-4 and 80-6, which selectively fire the print wires 22, 24 and 26, respectively associated therewith. In the description of the preferred embodiment, the left-hand bank 10A includes four actuators 80; the right-hand bank 10B three. This could, of course, be reversed. Moreover, if instead of the 5 × 7 matrix (having the seven print wires 21–27) of the preferred embodiment, a matrix of 7 × 9 (having nine print wires) is used, the added wires are divided as nearly as possible between the two banks 10A and 10B for firing thereby. Thus, there is no more than a one-wire difference between the total number of wires fired by the two banks. Other than the number of print wires 21–27 associated therewith, each bank 10A and 10B is essentially the same, the two being mirror images of each other, and; other than their height and location, each actuator 80 in a given bank is the same as the others. Each wire 21–27 is associated with its respective actuator 80, in a manner described more fully below and the actuators 80 in each bank 10A and 10B are vertically stepped and horizontally spaced in a manner similar to the actuator or driven end 55 of the print wires 21–27.

Specifically, each actuator 80 includes an armature 81 pivotable or rotatable on an axis 82 thereof, the construction of the armature 81 and the manner of their pivoting being described subsequently. A finger or extension 83 on, and pivotable with, each armature 81 extends into the space 52 between the banks 10A and 10B, and is coupled to the loop 71 at the actuator or outer end 55 of one print wire 21–27 (see below), so that pivoting movement of an armature 81 toward the platen 42 "fires" its coupled wire 21–27 and printing is effected. Movement and/or maintenance of the armatures 81 away from the platen 42 effects non-printing of the print wires 21–27. Movement of the print wires 21–27 toward and away from the platen 42 is guided by and constrained by the guide block 54, as described above.

Except for their vertical height relative to the mounting plate 56 and their varying distances from the platen 42, the actuators 80 are the same.

Actuator - Pole Pieces

Referring especially to FIGS. 1–6 and 12 each bank 10A, 10B contains a pair of pole pieces or plate 84 and 85. The pole pieces 84 and 85 are parallel to each other in each bank and contain a plurality of generally aligned slots or cut-outs 91–94. Conveniently, the pole pieces 84 and 85 may be fabricated by a simple stamping operation from the appropriate ferromagnetic metal. Similar plates 84—84 and 85—85 are, as assembled in the head 10, mirror images of each other.

Pole Piece 84

The right-hand plate 84 in the left bank 10A and the left-hand or inside plate 84 in the bank 10B contain a series of essentially vertical slots or cut-outs 91 having a step at the front thereof and being flat at the rear. The slots 91 define a plurality of vertical projections 95 therebetween the top rear of each of which is chamfered as shown at 96, and the rear of which is steppped while the front surface 97 of which is flat. (See FIGS. 2 and 5.)

The effective width of the slots 91 in the Y direction and at the upper end of the projections 95 is more than sufficient to allow for pivoting movement of the armatures 81 therein. Specifically, as described later, armature movement comprises rotation of the armature finger 83 about the armature axis 82 due to pivoting of the armature 81 on such axis 82. Moreover, the effective Y direction distance between the front surface 97 of any one projection 95 and a back surface of the guide 63 adjacent the next forward slot 91, must also be sufficient to permit such rotation. The vertical depth of the slot 91 is determined by magnetic flux concentration and isolation consideration, discussed subsequently. Suffice it to say that flux considerations aside, the slots 91 must have sufficient depth to accommodate the vertical dimension of the armatures 81. The front surfaces 97, of the projection 95 as well as the slots 91 are horizontally spaced in the Y direction in a manner similar to the spacing of the loops 71 at the actuator ends 55 of the wires 21–27. Bottom surfaces 100 of the slots 91 are vertically stepped upwardly from front-to-back similar to the vertical stepping of the wire ends 55.

At the bottom of the plate 84 are slots or cut-outs 93, having somewhat the general shape of a backward F as viewed from the space 52 between the banks 10A and 10B (FIGS. 5 and 6). The slots 93 are generally vertically aligned with the projections 95. The horizontal parts of the F 93 are generally semicircular in shape and define a tab 101 therebetween having a forward facing (i.e. facing the platen 42), flat, vertical surface 102.

Between the bottom of the slots 91 and the top of the slots 93 are flux isolation slots 92. These latter slots 92 create, within the limits of mechanical strength, the narrowest tolerable land portions 104 and 105, respectively, in the plates 84, as shown, for a purpose discussed later. The slots 92 are generally vertically aligned with the rear half of the slots 91.

Pole Pieces 85

The outside plates 85 are similar in most respects to the plates 84 and similar reference numerals have been used for corresponding features. Features with the same reference numerals and in a given bank 10A and 10B are aligned from plate to plate as viewed perpendicular to the plates' major surfaces (i.e., in the X direction). The projections 95 on the plate 84 are not chamfered as they are on the plate 84. Moreover, unlike the slots 93 in the plate 84, F-shaped slots 94 in the plates 85 are forward-facing as viewed from the outside of the head 10. The horizontal parts of the F 94 are also generally semicircular in shape and define a tab 105 therebetween having a generally backward facing, (i.e., away from the platen 42), flat vertical surface 106. Pairs of the F slots 93 and 94 in a given "bank" are generally aligned X-wise.

As viewed generally in the X direction, the flat front surfaces 97 of corresponding, aligned projections 95 are aligned. That is, a line drawn therebetween is perpendicular to the major surfaces of the plates 84 and 85, and to the center lines 51A or 51B of the respective banks 10A or 10B. Referring to FIG. 10, however, and as viewed in the same manner (X-wise) a line drawn between the corresponding surfaces 102 and 106 of the generally aligned tabs 101 and 105 defines an angle with the superjacent line drawn between the surfaces 97, because of an offset between the surfaces 102 and 106. The offset is such that the surface 102 of the tab 101 on the plate 84 is forward of (closer to the platen 42 than) the surface 106 of the tab 105 on the plate 85 as viewed on a line perpendicular to the center lines 51A and 51B.

Beside serving as magnetic pole pieces, the plates 84 and 85 are the mechanical frame for the banks 10A and 10B.

Actuators - Armatures 81

Each armature 81 includes a rectangular member 110 designed to be positioned in pairs of aligned slots 91—91 in the plates 84 and 85 in the banks 10A and 10B. The fingers 83 are connected to, and are preferably integral with, the members 110 and protrude beyond the projections 95 into the space between the banks 10A and 10B. In the unfired or unactuated position, the members 110 are maintained with their aligned slots pairs 91—91, a portion of the members 110 immediately adjacent the fingers 83 resting flush against the front surface 97 of the projection 95 in the plate 84. In the same position a portion of the members 110 remote from the fingers 83 rests flush against the front surface 97 of the projection 95 in the plate 85. Pivoting of the armatures 81 about their axes 82 is effected by using an outside corner 116 of the surfaces 97 of the projections 95 on the outside plates 85 as a pivot point for the members 110. Such pivoting results in the rotation of the member 110, and the finger 83 toward and away from the platen 42 to effect selective printing or non-printing of the print wires 21–27 connected to the fingers 83 by the loops 71. Use of the corner 116 as a simple pivot is one of the major simplifying features of the present invention. Operation of armatures 81 as described for $10^9$ cycles resulted in no detectable deleterious wear at the interface of the corner 116 and the member 110.

Attached to and preferably, formed integrally with each member 110 is a vertically disposed elongated torsion spring 118 in the preferred form of a rod-like member having a rectangular cross-section and formed by the same stamping operation which forms the member 110 and its integral finger 83. The torsion springs 118 are maintained on the outside (left of the plate 85 in the bank 10A; right of the plate 85 in the bank 10B) of the outside plates 85, the major axis 120 thereof being generally parallel to, but slightly displaced from, the pivoting axis 82, of the armatures 81, which axes coincide with the corner 116. While the thickness of the torsion springs 118 may be the same as that of the members 110, their width must in any event be such as to permit torsional deformation thereof for storage therein of potential energy. Typically, the torsion springs 118 measure .028 inch generally in the Y direction (thickness) and 0.055 inch generally in the X direction (width).

Attached to, and preferably formed integrally with and at the same time as, the torsion springs 118 are horizontal mounting bars 122. The bars 122 are used to mount the armatures 81 to the pole pieces 84 and 85 for rotation as follows: The rectangular members 110 are inserted into respective slots 91 in the plate 85 simultaneously with the insertion of the bars 122 into the slots 94 also in the plate 85. Continued insertion results in protrusion of the finger 83 from the slot 91 in the plate 84 and into the space 52, as described above, the protrusion of an end of the bars 122 from the slot 93 in the plate 84 also into the space 52. Opposite ends of the bars 122 immediately adjacent the torsion springs 118 are located outside the plates 85.

The ends protruding from the slot 93 may be bifurcated as shown at 126 and 128. The furcations 126 and 128 reside on either side of a lower, horizontal, rearward facing tab 130 formed in the plate 84 beneath and slightly longer than the tabs 101, the web between the furcations 126 and 128 resting on the top of the tab 130. Tabs 131, similar to the tabs 130 but forward facing are formed in the plate 85 beneath and slightly longer than the tabs 105. Both ends of the bar 122 rest on the top of these latter tabs 131. The bar ends, the tabs 130 and 131, and the furcations 126 and 128 all cooperate to maintain the bar 122 against the surfaces 102 and 106 of the tabs 101 and 105 in the plates 84 and 85, respectively.

Due to the offset of the surfaces 102 and 106 of the tabs 101 and 105, such mounting of the armatures 81 results in the members 110 assuming a neutral position whereat each member 110 rests against and is pivoted on the corner 116 of the projection 95 on the plate 85 at the same angle as the bars 122 relative to a perpendicular to the major surfaces of the plates 84 and 85 (as well as to the center lines 51A and 51B) and the finger 83 is spaced forwardly of the front surface 97 of the projection 95 in the plate 84.

After assembly in the banks 10A and 10B, the tops of the bars 122 are stepped upwardly from front to back, again, similar to the stepping of the ends 55 of the wires 21–27.

Actuators - Mounting of Wires 21–27 Thereto

The wires 21–27 are mounted to their respective armatures 81 by inserting the Fingers 83 into the respective loops 71. Specifically, the distance between the bend 74 and the front leg 73 of the loop 71 is slightly less than the thickness of the fingers 83 so that the fingers 83 are engaged therebetween. Preferably, after the armature 81 are all assembled in their respective banks 10A and 10B, such armatures are quickly, expeditiously and simultaneously associated with their print wires 21–27 which have already been mounted in and constrained by the guide block 54.

Because the armatures 81 rotate on their axis 82, and because the guide block 54 laterally constrains both the wires 21–27 and their respective loops 71, the loops 71 must be free to slide over the surface of the fingers 83. Specifically, from the standpoint of the laterally constrained loops 71, rotation of the armatures 81 results in an effective shortening thereof, thus slightly sliding the fingers 83 with respect to the loops 71. The loop-finger 71–83 fit, is designed to permit such sliding to take place. Again $10^9$ operations of such an arrangement resulted in no wear serious enough to adversely affect the operation of the print head 10.

Actuators - Permanent Magnets

An elongated, upwardly sloping (from back to front) cavity 132 is defined by the inside, facing vertical walls of the plates 84 and 85, an imaginary plane defined by the stepped tops of the bars 122, and an imaginary plane defined by the stepped tops of the slots 92. Into this cavity 132 in each bank 10A and 10B and in direct contact with the plates 84 and 85 is inserted an elongated permanent magnet 134 preferably a ceramic magnet, which when magnetized has a magnetic permeability about the same as that of air. As viewed in FIG. 2, when the magnet 134 in the left bank 10A is viewed from the rear, the North pole is to the left while the South pole is to the right. The reverse may also be true. The magnet 134 in the right bank 10B may have its South pole to the left and the North pole to the right, thus minimizing magnetic linkage between the two banks 10A and 10B. On the other hand, from the viewpoint of assembly the print head 10, it is usually preferably to have the North poles of both magnets 134 face the same way (left or right) as well as the South poles (right or left). While this latter arrangement may increase the flux linkage between the banks 10A and 10B to some extent (between the facing, oppositely magnetized poles of the magnets 134 along the center line 51), it offers facility in assembling the head 10. Specifically, the magnets 134 may be inserted into their respective cavities 132 in an unmagnetized state after assembly of the pole pieces 84 and 85 with the armatures 81. Prior to mounting the wires 21–27 to the armatures 81, armature-pole piece assembly may be conveniently subjected to a strong polarizing field as from a horseshoe electromagnet (not shown) associated with the assembled head 10 so as to magnetize the ceramic magnets 134 in a well-known manner.

Preferably, the ultimate strength of the magnets 134 is such that four ends are realized:

A. First, the members 110 of the armatures 81 are normally pulled against the respective front surfaces 97 of the projections 95 in the plate 84 to rotate the armatures 81 into the unfired position. Because such rotation of the members 110 varies from the previously defined neutral position to torsionally distort the torsion springs 118, potential energy is stored therein.

Each flux path or magnetic circuit is: From the North pole of the magnet 134, through land area 136 defined by adjacent flux isolating slots 92, through the front surface 97 of the projection 95 on the plate 85 through the member 110, through the front surface 97 of the projections 95 on the plate 84, through land area 136 on the plate 84, to the South pole of the magnet 134. It should be noted that the chamfer 96 serves its function in the magnetic circuit. Specifically, it has been found that reducing the width of the projection 95 near the finger 83, as by the chamfer 96, concentrates the flux to more effectively rotate and hold the armature 81 in the rest position.

B. The end 124 of each bar 122 is held against the surface 102; the end 125 is held against the surface 106. In both cases the force due to the magnetic attraction of the tabs 101 and 105 for the ends 124 and 125 is in aid of the mounting function performed by the tab-end 131–125 and the tab-end-furcations 130–124–126/128. The magnetic forces are sufficient to maintain the described position of the bars 122 notwithstanding any pivoting motion of the members 110. This is in part due to the flux concentrating effect of the tabs 101 and 105 of the F's 93 and 94 in attracting and holding the bar 122. It should be noted that the magnetic attraction between the tabs 101 and 105 and the bar is also quite strong because of the proximity of the magnet 134 thereto. Of course, the bar 122 may be mechanically mounted to the plate 84 or 85 or to the mounting frame 56 by deformation, screws, rivets or an adhesive, but the mounting described is preferred due to its simplicity and the ease of assembly the armatures 81 and plates 84 and 85, as well as to the convenient formation of the cavity 132.

Each flux path is: From the North pole of the magnet 134, through the land areas 136, through the tab 101 and 131 through the bars 122, through the tabs 105 and 130 in the plate 84, through the land areas 136 in the plate 84 to the South pole of the magnet 134.

C. The members 110 are held against either the front surface 97 of the projection 95 in the plate 84 (when the armatures 81 are unfired) or against the outside corner 116 of such surface 97 (when the members 110 are pivoted away from the front surface 97 of the projection 95 in the plate 84). In this way the pivoting of the members 110 on the corners 116 is quite simple — no bearings, hinges or the like are necessary — the magnetic attraction of the corner 116 therefor being sufficient.

D. The plates 84 and 85 are maintained in a rigid, stable structure.

Actuators - Electromagnets

As described above, the basic actuator 80 for the print wires 21–27 includes the stamped metal armatures 81 (comprising the finger 83, the member 110, the torsion spring 118, the bar 122), the stamped metal pole pieces 84 and 85 (including the slots 91–94), and the permanent magnets 134, all assembled together with the wires 21–27 in the guide block 54 in a simple structure to form the banks 10A and 10B.

Each actuator 80 also includes facilities 138, such as an electric coil, for effecting the selective firing of its associated print wire 21–27.

The function of each coil 138 is, upon selective application thereto of a voltage, to counteract or neutralize the magnetic flux normally holding the portion of the member 110 adjacent the finger 83 against the front surface 97 of the projection 95 in the plate 84. Such counteraction on neutralization permits the stored potential energy in the torsion spring 118 to rapidly move the member and finger (110 and 83) forward toward the platen 42, thus firing the associated print wire 21–27 to effect printing on the paper 12.

Each coil 138 includes a bobbin 140 made of a phenolic resin or other convenient electrical insulator. Wound on the bobbin 140 are a plurality of turns 142 of an insulated wire of a sufficient number and in a proper direction and having sufficient current carrying capacity to counteract the magnetic flux of the permanent magnet 134 at whatever point in the actuators 80 the coils 138 are located as discussed below.

The preferred mounting position for the coils 138 has been found to be a position surrounding, but not mechanically loading, the members 110. Specifically, flanged ends 144 of the bobbins 140 are mounted between the plates 84 and 85 to the interior facing surfaces of the projections 95 in such a way that a central bore 146 of the bobbin 140 surrounds its associated member 110. Because the volume swept out by the member 110 during rotation of the armature 81 in a wedge having a rectangular cross section, the bore 146 is preferably rectangular in cross section, although other configurations may be used. Of course, the bore 146 is sufficiently large so as not to interfere with the pivoting of the member 110 about the corner 116. Such mounting of the flanged ends 144 may be effected by locating fingers 148 formed integrally with the bobbin flanges 144 and which are complementary in shape to the stepped shape of the slots 91 in the plates 84 and 85. Of course, other mounting schemes may also be used, as, for example, adhering a part of the flanges 144 to the projections 95 with an appropriate adhesive. This latter scheme somewhat facilitates the winding of the wire turns 142 on the bobbin 140 by eliminating the locating fingers 148.

Application of an appropriate voltage to the coil 138 results in the generation of magnetic flux, the coil 138 and the member 110 together acting as an electromagnet 138/110. This flux counteracts the flux of the permanent magnet 134 such that a selected print wire 21–27 is fired. The counteracting flux as viewed in FIG. 2 is primarily confined to a magnetic circuit as follows: From the electromagnet's north pole (here the portion of the member 110 remote from the finger 83) through the air to the south pole (here the portion of the member 110 adjacent the finger 83). Any tendency of the flux of one coil 138 to affect an armature 81 other than its own armature 81 (so-called "crosstalk") is obviated by two features, namely, the slots 91–94 and the near-air permeability of the ceramic magnet 134. A third feature, the thickness of the member 110, may also be adjusted to obviate crosstalk.

First, the slots 91–94, as discussed previously, have the effect of creating narrowed land portions, such as those at 103, 104 and 136. Viewed from the standpoint of the flux generated by the coil 138 in the electromagnet 138/110, the magnetic path from north to south through the plates 84 and 85 (i.e., the path from the north pole of the electromagnet 138/110, through the adjacent projection 95; through the lands 103 and 104 on the plate 85; up through the next forward, and/or rearward projection 95 on plate 85 through the next forward or rearward member 110; down through the adjacent projection 95 on the plate 84; through lands 103 and 104 on the plate 84, up through the projection 95 on plate 84 adjacent the south pole of the electromagnet 138/110) has a much higher magnetic reluctance than the magnetic circuit (the member 110 and air) associated with the particular electromagnet 138/110 energized.

Second, the permeability of the permanent ceramic magnets 134 being about equal to that of air, as is well-known, there is no lower reluctance path than the one just described between the plates 84 and 85 above the lands 102 and 103. In fact, any path through the permanent magnet 134 probably has an even higher reluctance than the more tortuous path through such lands 102 and 103.

Third, although not necessary, the thickness of the members 110 may be increased, as by attaching thereto a piece of a ferromagnetic material to further decrease the reluctance thereof. The reluctance of the magnetic path formed by the member 110 and air for the electromagnet 138/110 may thus be so lowered as to essentially prevent any crosstalk.

It should also be noted that movement of one of the members 110 away from the front surface 97 of the projection 95 potentially has the effect of increasing the magnetic attraction between other members 110 and their respective projections 95. Specifically, the flux from the permanent magnet 134 formerly passing through the now-pivoted member 110 tends to divide itself via the pole pieces 84 and 85 through any non-pivoted members 110, because the now-formed air gap between the pivoted member 110 and the projection 95 increases the reluctance of that member's magnetic circuit as to permanent magnet flux. However, the combination of the slots 91–94 and the smallness of such air gap, being typically 0.045 inch, nearly obviates this effect. In any event, each coil 138 may easily be so designed as to be able to generate sufficient magnetic flux to permit pivoting of its associated armature 81 over the entire range of possible attractive forces between its related member 10 and the projection 95.

Referring now to FIGS. 3 and 12, the two ends 149 of the wire 142 wound on each bobbin 140 are respectively positioned adjacent to a pair of horizontal apertures 150 formed through the lower part of the bobbin flange 144 which abuts the inside surface of the inside plates 84. The apertures 150 are aligned with L-shaped bores 152 formed in the locators 148. The bores 152 run first horizontally away from the apertures 150 and then downwardly to the end of the locator 148 near the bottom 100 of the slot 91. The bores 152 contain a pair of rigid wire members 154 which run vertically down past the end of the locator along the outside of the plates 84. The upper ends of the wire members 154 are connected, as by soldering, to the ends 149 of the wire 142 near the apertures 150. The lower ends of the wire members 154 are connected by appropriate means to a drive circuit 156 for each coil 138. Typically, the coils 138 are assembled with the plates 84 and 85 by sliding the locators 148 into the complementary shaped slots 91 prior to assembly of the armature 81 thereon. Such assembly of the armatures 81, then, entails in part insertion of the member 110 into the bore 146. As shown in FIG. 12, assembly of the guide blocks 54 may effect rigid placement of the coils 138 in the preferred embodiment where an adhesive is used to attach the flanges 144 to the plates 84 and 85. Specifically, when the block 54 is attached to the plates 84 and 85 as by screws 157 (FIG. 2) the members 61A and 61B of the wedge 61 bear against and lock the locators 148 as well as locating the guide block 54.

Typically, the connection between the wire members 154 and the drive circuit 156 may comprise in part printed circuit paths 158 formed on a printed circuit board 158 (FIGS. 1, 2 and 6) in any well known manner. In the preferred embodiment described, the printed circuit board 158 is located above the cutout 57 of the frame 56 and may be attached at its front and rear to the hold down 86 and the frame 56, respectively, by screws 161 as shown in FIGS. 2 and 6. Conveniently, the paths 158 are connected to the drive circuits 156 by a flexible cable and plug 162 (FIG. 6) which runs from beneath the board 160 to such circuits 156 located elsewhere in the teleprinter. The wire members 154 pass through apertures 163, which may be plated through-holes, in the board 160 and are connected to their respective printed circuit paths 158 by soldering.

Actuators - Drive Circuits 156

The function of the drive circuits 156 is to selectively apply a voltage to one or more selected coils 138 to generate a current in the wire 142 thereof which in turn generates a magnetic field for counteracting or neutralizing the magnetic field of the permanent magnet 134. Ideally, due to power and speed considerations, the current through the coil 138 should rise sufficiently fast and be of sufficient magnitude to generate the counteracting magnetic field as quickly as possible; then such current and the counteracting magnetic field should both decay in a manner so that printing is effected. After printing, the current and the resulting counteracting field should be low enough so that the armature 81 is returned primarily due to the magnetic pull of the permanent magnet 134 to its rest position in the shortest possible time.

Specifically, experimentation has shown that it is during the decay of the current in the coil 138 that the armature 81 moves to print. More specifically, due to mechanical inertia of the armature-finger-spring 81-83-118 and to the finite time it takes for the field of the permanent magnet 134 to become sufficiently neutralized in a particular armature 81 to permit movement thereof, the torsion spring 118 begins to move such armature at a time near that at which the coil current reaches its maximum. As coil current decays, the influence of the permanent magnet 134 on the armature 81 begins to increase even though the armature 81 and the finger 83 may have moved away from the projection 95. Thus, if decay of the coil current is too rapid, the armature 81 either does not move at all, or is pulled back to the rest position before printing is ever effected. If such decay is too slow the armature's print wire 21–27 may remain fired for too long (tearing the paper 12 on the ribbon 41) and the repetition rate of the head 10 becomes too slow. Thus, the control circuit 156 should be capable of striking a balance between quite rapid and quite slow decay of the coil current.

Also, the rise of the coil current, while not playing a direct role in armature movement is, of course, necessary so that sufficient flux is generated to counteract the field of the permanent magnet. If this rise is too slow, not only is the head's repetition rate slowed, but also power consumption increases. A "too rapid" current rise is not detrimental, and, if practical, may increase the head's repetition rate.

It should also be noted that coil current decay is usually completed before the armature 81 returns to the rest position. Thus, in general, each cycle of operation of a given armature starts with beginning of current rises in the coil and ends with the return of the armature to the rest position.

Referring now to FIG. 14 an example of a simple electrical drive circuit 156 for accomplishing the above ends are depicted. Other arrangements may similarly be used as long as the criteria described above are met.

Referring to FIG. 14, each drive circuit 156 includes the coil 138 of one of the actuators 80. The coil 138 is connected in parallel with a diode 164. The cathode of the diode 164 and one end of the coil 138 are connected to a voltage source 166 such as plus 40 volts D.C. The anode of the diode 164 and the other end of the coil 138 are connected to the collector 168 of a normally off transistor 170. The emitter 172 of the transistor 170 is grounded.

When it is desired to effect the printing of a selected print wire 21–27 appropriate logic circuitry 174 connected to the base 176 of the transistor 170 generates a pulse which turns the normally off transistor 170 on. Turning on the transistor 170 opens a conductive path from the voltage source 166 through the coil 138 to ground through the emitter 172 and the collector 168. As noted previously the direction of the winding of the wire 142 on the bobbin 140 and the number of turns thereof are such that the current passing through the coil 138 is sufficient to counteract or neutralize the field from the permanent magnet 134. After the logic circuitry 174 has generated the pulse for firing the selected print wire 21–27, the transistor 170 returns to its normally off condition. At this point in time current tends to continue to flow through the coil 138. Such current now circulates in the circuit through the diode 164 until it is dissipated. That is, such current slowly decays back toward zero. As the current decays toward zero the counteracting or neutralizing effect of the coil 138 is continuously decreased, ultimately permitting the field of the permanent magnet 134 to pull the armature 81 back to its rest position against the surface 97.

Actuators - Miscellaneous

As shown in FIGS. 4 and 10, the armatures 81 may be partially covered by a layer of polyester film or tape 250 at selected locations. Typically the film is about 0.002 inch thick. The film has been found to prevent fretting corrosion especially at the interface of the armature member 110 and the corner 116.

A first possible location for the tape 250 is on the portion 112 of the member 110 adjacent the finger 83. Specifically, the film 250 is adhered to the portion 112 in any connvenient way so that it is sandwiched between that portion and the front surface 97 of the projection 95 on the plate 84 when the armature 81 is in the rest position. The film 250 thus provides a "built-in" gap between the member 110 and the surface 97 to prevent the member 117 "freezing" therebetween. As is well known, the magnetic attraction between two ferromagnetic objects decreases as the square of the distance between them. Thus, it is slightly easier for the torsion spring 118 to move the armature 81 upon neutralizing of the permanent magnet 134 by the coil 138 when the film 250 is used.

Another advantage realized by use of the film 250 at the first location is that upon the rapid return of the armature 81 to the rest position, rebound or bounce of the armature 81 from the surface 97 is reduced. Reduction of this rebound is achieved by the damping effects of the film 250 which depends on judicious selection of the material of the film 250.

A second possible location for the film 250 is at the interface of the member 110 and the corner 116. Here, the film 250 effects a wear reducing function and may with appropriate selection effect a lubricating function, as should be obvious.

As in the case of the first position, a "built-in" gap is created by the film 250 at the interface of the second position. Such gap resides between the portion 114 of the member 110 and the front surface 97 of the projection 95, on the plate 85. This gap is not necessarily as desirable as the first gap, but the permanent magnet 134 has sufficient strength to maintain the portion 114 adjacent the film 250 on the corner 116 during pivoting of the armature 81.

A third possible location for the film 250 is on the finger 83. As noted above, because the armatures 81 rotate on their axes 82, and because the guide block 54 prevents any lateral (X direction) movement of the wire 21–27, including the loops 71 thereof, the effective "shortening" of the armature 81 causes the finger 83 to slide beneath the front loop arm 73 and the bend 74. Thus, the film 250 on the finger 83 both prevent wear and provides lubrication for such sliding.

The film 250 may be placed on the members 110 at one or more of the three possible locations. Conveniently the film is placed thereon in a single piece overlying both the front and back surfaces of the fingers 83 and then running along and covering the back side of the member 110 where it contacts the respective surfaces 97.

Each actuator 80 may include a tension adjustment 256 for altering the amount of potential energy stored in the torsion springs 118. Specifically as shown in FIGS. 3 and 10 (left side) a boss 258 having a threaded hole 260 therethrough may be formed on the outside of the plates 84 immediately behind the furcation 126 of the end 124 of the bar 122. Threaded into each hole 260 is a set screw 262 bearing against the furcation 126. Rotation of the screw 262 to move the furcation 126 and the bar end 124 forward toward the platen 42 increases the amount of potential energy in the torsion spring 118, considering the armature 110 to be held in the rest position by the magnet 134, by further increasing the angle B.

Other arrangemenets may be used for adjusting tension. For example, individual set screws (not shown) may be mounted to the inside of the plate 84 behind the furcation 178 in a manner similar to that described immediately above. On the other hand as shown in FIG. 10 (right side) a single tension adjustment 264 for all of the torsion springs 118 in a single bank 10A or 10B may be used. Specifically, bosses 258 similar to those discussed above are similarly located on the plate 84. Only the hole 260 on the forwardmost boss 258 is threaded, however, the rest of the holes 260 being unthreaded. An elongated shaft 266 having its front end threaded into the forwardmost boss 258 passes slidably through the other holes 260 via notches 268 formed in the ends 124 of the arms 122. Attached to the shaft 266 and bearing respectively on the arm ends 124 are a plurality of collars 270. Rotation of the shaft 266, then, moves the ends 124 backward or forward simultaneously to adjust the tension in the torsion springs 118.

Either tension adjustment scheme may be useful when greater force at the printing ends 30 is desired, as, for example, when numerous carbon copies of the data printed on the paper 12 are desired. Of course, giving due consideration to the strength of the magnet 134, the flux concentration at the surface 102, and the attraction between that surface and the arm end 124 care must be taken not to move the end 124 so far from the surface 102 that the magnetic attraction therebetween is broken. Generally, tension adjustment will effect only small incremental distances between the end 124 and the surface 102. Gross tension in the spring 118 is, of course, determined by the offset between the surfaces 102 and 106 as discussed previously.

Although several specific embodiments of the invention are shown in the drawings and described in the foregoing specification, it should be understood that the invention is not limited to such specific embodiments, but is capable of modification and rearrangement and substitution of parts and elements without departing from the spirit of this invention. For example, instead of the angularly related banks 10A and 10B, the print head 10 may contain print wires all-in-a-line. Also, it may be desirable to mount the coils 138 elsewhere than surrounding the armatures 81, for example on one or both projections 95 of each actuator 80. Moreover, the relative locations of the members 110, the torsion springs 118 and the connection between the print wire loops 71 and the fingers 83 may be changed and altered as desired.

What is claimed is:

1. In a wire matrix printer, an actuator for selectively impacting an end of a print wire on a recording medium, comprising:

a. an armature of ferromagnetic material having an elongated body to which the print wire is mounted at a first end thereof, the armature being rotatable in a circular arc about an axis of rotation adjacent to a second end thereof and perpendicular to the body, for moving the print wire end toward and away from the recording medium;

b. a rotatable torsion rod attached to the second end of the armature and extending parallel to the axis of rotation of the armature, the armature assuming a neutral position when the torsion rod is free of torsional stress;

c. means for normally magnetically attracting the armature to a rest position by rotating the armature on the axis away from the neutral position to move the wire end away from the recording medium and to twist the torsion rod to torsionally stress the torsion rod; and d. means for neutralizing the magnetic attraction so that the torsionally stressed rod rotates the armature toward the neutral position to drive the print wire end toward the recording medium for impacting the wire end thereon.

2. The actuator of claim 1 which further comprises:

e. means for momentarily energizing the neutralizing means to impact the wire end on the recording medium, de-energization of the neutralizing means permitting the attracting means to return the armature to the rest position.

3. The actuator of claim 2 which further comprises:

f. means for mounting the wire to the armature to impact the wire end on the recording medium as the armature reaches the neutral position upon energization of the neutralizing means.

4. In a matrix printer, an actuator for selectively impacting an end of a print wire on a recording medium, comprising:

a. an armature to which the print wire is mounted, the armature being pivotable about an axis for moving the print wire end toward and away from the recording medium;

b. a torsion spring attached to the armature, the armature assuming a neutral position when the spring is free of torsional stress;

c. means for normally magnetically attracting the armature to a rest position by pivoting the armature on the axis away from the neutral position to move the wire end away from the recording medium and to torsionally stress the spring;

d. means for neutralizing the magnetic attraction thus permitting the torsionally stressed spring to pivot the armature toward the neutral position and to move the wire end toward the recording medium for impacting the wire end thereon;

e. means for momentarily energizing the neutralizing means to impact the wire end on the recording medium, de-energization of the neutralizing means permitting the attracting means to return the armature to the rest position; and f. means for mounting the wire to the armature to impact the wire end on the recording medium as the armature reaches the neutral position upon energization of the neutralizing means;

the neutralizing means comprising ($d_1$) an electrical coil positioned about and surrounding, but not mechanically loading, the armature which is free to pivot within a central bore of the coil.

5. The actuator of claim 4 wherein the attracting means comprises:

$c_1$. a first ferromagnetic pole piece, a portion of which coincides with the armature axis, the armature being pivotable on the portion;

$c_2$. a second ferromagnetic pole piece spaced from the first pole piece and located adjacent the wire to-armature mounting means, the armature abutting the second pole piece in the rest position; and $c_3$. a permanent magnet between the pole pieces.

6. The actuator of claim 5 which further includes:

g. means for mounting the torsion spring to the pole pieces to space the armature from the second pole piece in the neutral position.

7. In a matrix printer, the combination comprising a plurality of actuators as recited in claim 6, and further comprising:

means for separating the wire ends at the recording medium to define a matrix; and means for maintaining the print wires of the actuators mutually parallel for movement along their major axes so as to form a bank of the actuators.

8. The combination of claim 7, wherein the pole pieces are mutually parallel projections, and which further comprises:

a first ferromagnetic plate member supporting the first pole pieces and contacting one pole of the magnet; and a second ferromagnetic plate member supporting the second pole pieces and contacting the other pole of the magnet.

9. In a matrix printer, the combination comprising a plurality of actuator assemblies as recited in claim 8, and which further comprises:

means for alternately interleaving the print wire ends at the recording medium so as to form a print head.

10. The combination of claim 9 which further comprises:

means for relatively moving the print wire ends and the recording medium to traverse such wire ends over the medium.

11. The combination of claim 10 wherein the banks are angularly related to an axis of the printer so that the banks lie side-by-side in the direction of the traversal of the print wire ends over the medium.

12. The combination of claim 11 wherein the wire to-armature mounting means, the wire end separating means, the wire maintaining means, and the interleaving means comprise:

a guide block positioned between adjacent banks of actuators;

a plurality of guide members periodically supporting the wires in mutual parallelism;

a U-shaped loop formed in each wire remote from the wire ends, the legs of each loop engaging a respective armature therebetween;

a channel formed in the block between the guide members and extending in the direction of wire movement, the bridges of the loops resting in and being guided by the channel; and a nib adjacent the recording medium for receiving in bores therthrough the wire ends in an interleaved, spaced-apart fashion.

13. The actuator of claim 6 wherein the torsion spring mounting means comprises:

an elongated ferromagnetic bar connected to the torsion spring remote from the armature; and means on one of the pole pieces for applying the magnetic flux of the magnet to the bar to maintain the bar in a fixed position to set the neutral position of the armature.

14. In a matrix printer, a device for selectively impacting an end of an elongated print wire on a recording medium held on a platen, comprising:

a. an elongated, rotatable torsion rod;

b. a ferromagnetic armature having an elongated, nonflexible body to which the print wire is mounted at a first end thereof, the armature being attached adjacent to a second end thereof to the torsion rod for rotation about the major axis of the rod to move the print wire, the armature assuming a neutral position when the rod is unstressed;

c. means for attracting the armature with a static magnetic field to normally move and maintain the armature in a rest position by rotating the armature out of the neutral position to twist the torsion rod so as to store potential energy in the torsion rod; and d. means selectively energizable for momentarily neutralizing the static magnetic field so that the torsion rod untwists and the stored potential energy in the rod rotates the armature away from the rest position and toward the neutral position whereat the wire end impacts on the recording medium.

15. The device of claim 14 wherein the neutralizing means comprises:

$e_1$. means for selectively generating a second magnetic field having a polarity, relative to the armature, which is opposite that of the static field.

16. In a matrix printer, a device for selectively impacting an end of an elongated print wire on a recording medium held on a platen, comprising:

a. an elongated torsion spring;

b. a ferromagnetic armature attached to the torsion spring for pivoting about the major axis of the spring to move the print wire, the armature assuming a neutral position when the spring is unstressed;

c. means for attracting the armature with a static magnetic field to normally move and maintain the armature in a rest position by pivoting the armature out of the neutral position to store potential energy in the torsion spring; and d. means selectively energizable for momentarily neutralizing the static magnetic field to permit the stored potential energy to pivot the armature away from the rest position and toward the neutral position whereat the wire end impacts on the recording medium;

the neutralizing means comprising ($e_1$) means for selectively generating a second magnetic field having a polarity, relative to the armature, which is opposite that of the static field, the second magnetic field being dynamic and the second field generating means being an electromagnet comprising ($e_{11}$) a coil wound about, but not mechanically loading the armature; and ($e_{12}$) selectively operable means for applying a voltage to the coil.

17. An improved two position actuator of the type in which an armature is attracted to a first position by a magnet against the action of a resilient member, thereby storing potential energy in the member, which energy biases the armature toward a second position; and selective energization of an electric coil neutralizes the magnetic attraction of the magnet for the armature to permit the resilient member to move the armature to the second position, wherein:

a. the resilient member is a torsion spring; and b. the coil surrounds, but does not mechanically load, the armature.

18. The actuator of claim 17 wherein the armature is mounted on the torsion spring for rotation about a torsional axis of the spring, and the magnet is a permanent magnet normally attracting the armature to the first position when the coil is de-energized.

19. The actuator of claim 18 which further comprises:

c. a pair of pole pieces respectively adjacent opposite poles of the magnet, both pole pieces contacting the armature in the first position, the armature being rotatable on a first of the pole pieces to move the armature away from a second of the pole pieces when the armature moves to the second position.

20. The actuator of claim 19 which further comprises:

d. an elongated wire-like member attached to the armature for movement therewith to move one end of the member into a selected position when the armature is in its second position and to move the one end away from the selected position when the armature is in its first position.

21. The actuator of claim 20 wherein the armature includes an elongated rectangular member, one end thereof being both attached to the torsion spring and adjacent to the first pole piece, the other end thereof being rotatable about the spring's torsional axis into contact with the second pole piece at the first armature position and away from the second pole piece at the second armature position.

22. The actuator of claim 21 wherein the pole pieces comprise first and second generally mutually parallel projections, the projections being parallel to the torsional axis of the spring and perpendicular to the direction of armature movement.

23. The combination comprising a plurality of the actuators as recited in claim 22, and means for mounting the actuators in an actuator bank wherein the ends of the wire-like members are separated from each other at the selected position to define a matrix.

24. The combination of claim 23 wherein the major axes of the wire-like members are mutually parallel, and which further comprises:

f. means for mounting the wire-like members for reciprocating motion along their major axes upon movement of their respective armatures.

25. The combination of claim 24 which further comprises:

g. a first common plate member on which the first projection are mounted; and h. a second common plate member on which the second projections are mounted, the plate members respectively contacting opposite poles of the magnet.

26. The combination of claim 25 wherein the first and second projections associated with each armature are mounted to their respective plate members on the same side of such associated armature.

27. An improved two position actuator of the type in which an armature is attracted to a first position by magnet means in opposition to resilient means, thereby storing in the resilient means potential energy which biases the armature toward a second position, and in which there is selectively energizeable means for neutralizing the magnetic attraction permitting the stored energy to move the armature to the second position, characterized in that:

a. the resilient means comprises a torsion spring on which the armature is mounted for rotation on a rotational axis of the armature and about a torsional axis of the spring;

b. the magnet means comprises a permanent magnet normally attracting the armature to the first position; and c. the neutralizing means comprises an electric coil surrounding the armature but not mechanically loading the armature.

28. The actuator of claim 27 wherein the magnet means further comprises a ferromagnetic pole pieces both contacting the armature at its first position, the pole pieces being respectively adjacent the opposite poles of the permanent magnet.

29. The actuator of claim 28 wherein the pole pieces comprise:

d. respectively, spaced-apart first and second elongated projections, the first projection having an edge coinciding with the rotational axis and remaining in contact with the armature during rotation thereof toward the second position, the armature moving away from the second projection during rotation thereof toward the second position.

30. The actuator of claim 29 wherein the spring is elongated and attached at one end to the armature, the actuator further comprising:

e. a ferromagnetic arm attached to the other end of the spring; and f. means on the pole pieces for holding the arm stationary during rotation of the armature.

31. The actuator of claim 30 wherein the arm holding means comprises:

g. tabs on the pole pieces for magnetically attracting and holding the arm by applying the flux of the magnet thereto.

32. The actuator of claim 31 wherein the arm, the projections and the armature define a cavity for holding the magnet.

33. The actuator of claim 32 which further comprises:

h. means for moving the arm about the torsional axis of the spring to adjust the amount of potential energy stored in the spring when the armature is in the first position.

34. The actuator of claim 38 which further comprises:

d. an elongated member having an end;

e. means for mounting the elongated member for movement of the end into and away from a selected position; and f. means responsive to movement of the armature to the second position for moving the end into the selected position, and responsive to movement of the armature to the first position for moving the end away from the selected position.

35. The actuator of claim 34 wherein the elongated member mounting means comprises:

a guide block;

a plurality of guide fingers having apertures therethrough for receiving the elongated member periodically along the length of the elongated member;

a U-shaped loop formed in the elongated member; and a channel in the block intermediate the guide fingers which receives the bridge of the U and a part of the legs of the U adjacent the bridge for sliding motion therein.

36. The actuator of claim 35 wherein the guide finger apertures and the block channel are so arranged that movement of the elongated member is linear and along the major axis thereof.

37. The actuator of claim 36 wherein the end moving means comprises:

an extension of the armature positioned in the loop and engaged by the legs of the loop.

38. An improved print wire-actuator bank for a matrix print head of a matrix printer of the type in which:

a. the ends of a plurality of elongated print wires are respectively, selectively impacted by a plurality of actuators against a record medium in a matrix;

b. the print wires and their respective actuators are mounted to the head which is traversed across the medium to print lines of alpha-numeric characters thereon in accordance with the selective wire end impaction;

c. each actuator includes a movable armature for moving an associated wire therewith, each armature being attracted to a first position by associated magnet means against the action of an associated resilient member, thereby storing in the member potential energy biasing each armature toward a second position, each wire end impacting on the medium only at the second armature position, and means associated with each armature for selectively, momentarily neutralizing the magnetic attraction of the magnet means for that armature to permit the stored energy of such armature's resilient member to move the armature from the first to second position and to impact the end of its print wire against the medium, wherein the improvement comprises:

I. the resilient members are torsion springs on which each armature is respectively mounted for rotation on a rotational axis of the armature and about a torsional axis of the spring;

II. each neutralizing means comprises an electric coil surrounding but not mechanically loading its respective armature;

III. the magnet means associated with each armature comprises;

a pair of pole pieces both of which contact the armature in its first position, a first one of which pole pieces coincides with the rotational axis of, and remains in contact with, the armature during its movement to the second position, a second one of which pole pieces becomes spaced from the armature in its second position; and a permanent magnet, opposite poles of which are respectively adjacent the pole pieces;

IV. each print wire includes a U-shaped loop remote from the print end thereof;

V. each armature includes a portion contained within the U-shaped loop and engaged by the legs thereof; and wherein the improvement further comprises:

VI. a first ferromagnetic plate attached to all of the first pole pieces and contacting one pole of the magnet;

VII. a second ferromagnetic plate attached to all of the second pole pieces and contacting the other pole of the magnet;

VIII. means on each torsion spring for respectively mounting each spring to the first and second plates, the spring mounting means including:

an arm fixed to the spring; and means for applying flux from the magnet to the arm to maintain the arm stationary during armature movement; and IX. guide means for ensuring movement of the wires toward the medium along the major axes thereof and for preventing bending of the wires during impact, the guide means including:

a plurality of guide members spaced along the wires and having apertures therethrough for receiving and periodically supporting the wires; and a guide block having a channel therein for receiving the U-shaped loops to prevent rotation and movement of the wires in directions transverse to their major axes.

39. An improved matrix printer of the type which includes (A) a print head having a plurality of elongated print wires the ends of which are selectively impacted on a recording medium held on a platen and (B) means for moving relatively the medium and the print head, wherein the improvement comprises:

a. actuator means connected to each print wire to selectively impact the ends thereof on the medium, each actuator including i. an armature, ii. a torsional resilient member connected to the armature, iii. magnetic means for normally attracting the armature to a first position against the action of the resilient member to store potential energy in the member, which stored energy biases the armature toward a second position, the print wire end being impacted on the medium only at the second armature position, and iv. an electric coil surrounding but not mechanically loading the armature, selective energization of the coil neutralizing the magnetic attraction of the magnet for the armature to permit the resilient member to move the armature to the second position; and b. means for maintaining the print wires in straight, mutually parallel array over their lengths and for maintaining the ends thereof in a matrix at and near the medium.

40. The printer of claim 39 which further comprises:

c. a plurality of banks each containing some of the print wires and the actuator means therefor, and d. means for alternatively interleaving the ends of the print wires contained in the respective banks.

41. The printer of claim 40 wherein the print head has a printing axis normal to the medium and generally parallel to the direction of print wire movement which printer further comprises:

e. means for mutually, angularly mounting the banks to the head on either side of the printing axis.

* * * * *

UNITED STATES PATENT OFFICE

CERTIFICATE OF CORRECTION

PATENT NO. : 3,982,622
DATED : September 28, 1976
INVENTOR(S) : JOSEPH A. BELLINO-DAVID G. GEIS-INGARD B. HODNE-ARTHUR F. LINDBERG It is certified that error appears in the above-identified patent and that said Letters Patent are hereby corrected as shown below:

Column 21, line 57, change "arrangemenets" to --arrangements--

Column 24, Claim 11, line 17, after "banks" insert --of actuators--.

Column 25, Claim 17, line 41, after "and" insert --in which--.

Column 26, Claim 28, line 57, after "a" insert --pair of--.

Column 27, Claim 34, line 24, change "claim 38" to --claim 28.

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*